US012478137B2

(12) United States Patent
Henrichot et al.

(10) Patent No.: US 12,478,137 B2
(45) Date of Patent: Nov. 25, 2025

(54) ARTICLE OF FOOTWEAR UPPER INCORPORATING A TEXTILE COMPONENT WITH TENSILE ELEMENTS

(71) Applicant: NIKE, Inc., Beaverton, OR (US)

(72) Inventors: Olivier Henrichot, Tigard, OR (US); Bryant R. Klug, Beaverton, OR (US); Elizabeth Langvin, Sherwood, OR (US); Timothy K. Liles, Portland, OR (US); Adrian Meir, Portland, OR (US); Nathan G. Schultze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/642,312

(22) Filed: Apr. 22, 2024

(65) Prior Publication Data

US 2024/0268521 A1 Aug. 15, 2024

Related U.S. Application Data

(63) Continuation of application No. 17/517,269, filed on Nov. 2, 2021, now Pat. No. 11,986,054, which is a (Continued)

(51) Int. Cl.
*A43B 1/04* (2022.01)
*A43B 7/24* (2006.01)

(Continued)

(52) U.S. Cl.
CPC ..... *A43B 23/0245* (2013.01); *A43B 7/24* (2013.01); *A43B 23/02* (2013.01);

(Continued)

(58) Field of Classification Search
CPC ..... A43B 1/04; A43B 23/02; A43B 23/0205; A43B 23/02045; A43C 1/04; A43C 5/00

(Continued)

(56) References Cited

U.S. PATENT DOCUMENTS 541,916 A 7/1895 Bowman
601,192 A 3/1898 Woodside (Continued)

FOREIGN PATENT DOCUMENTS

AU 2012368048 A1 8/2014
CN 2538173 Y 3/2003

(Continued)

OTHER PUBLICATIONS

Exhibit No. 2007, received in PTAB IPR No. 2019-01190, dated Sep. 19, 2019, 2 pages.

(Continued)

*Primary Examiner* — Marie D Bays

(74) *Attorney, Agent, or Firm* — Shook, Hardy & Bacon L.L.P.

(57) ABSTRACT

An article of footwear includes a textile component. The textile component of the upper includes a textile element and a tensile element. The tensile element defines a first segment disposed on a first side of the upper. The first segment of the tensile element is configured to attach the securement device to the textile element on the first side of the upper. The tensile element further includes a second segment that is disposed proximate the lower portion of the upper on the second side. The second segment is fixed relative to the lower portion of the upper on the second side. The tensile element further includes an intermediate segment that extends continuously from the first segment, across the heel region, to the second segment.

20 Claims, 19 Drawing Sheets

Related U.S. Application Data continuation of application No. 16/686,413, filed on Nov. 18, 2019, now Pat. No. 11,197,518, which is a continuation of application No. 15/807,116, filed on Nov. 8, 2017, now Pat. No. 10,477,920, which is a continuation of application No. 14/880,707, filed on Oct. 12, 2015, now Pat. No. 9,826,798, which is a continuation of application No. 14/535,648, filed on Nov. 7, 2014, now Pat. No. 9,192,204.

(60) Provisional application No. 62/057,650, filed on Sep. 30, 2014, provisional application No. 62/057,264, filed on Sep. 30, 2014.

(51) Int. Cl.

| | |
|---|---|
| ***A43B 23/02*** | (2006.01) |
| ***A43C 1/00*** | (2006.01) |
| ***A43C 1/04*** | (2006.01) |
| ***A43C 11/00*** | (2006.01) |
| ***D04B 1/12*** | (2006.01) |

(52) U.S. Cl.

CPC ..... *A43B 23/0265* (2013.01); *A43C 1/00* (2013.01); *A43C 1/04* (2013.01); *A43C 11/00* (2013.01); *D04B 1/123* (2013.01); *D10B 2403/0113* (2013.01); *D10B 2403/032* (2013.01); *D10B 2501/043* (2013.01)

(58) Field of Classification Search

USPC ..... 36/45, 50.1

See application file for complete search history.

(56) References Cited

U.S. PATENT DOCUMENTS

| | | | |
|---|---|---|---|
| 951,033 | A | 3/1910 | Steber |
| 1,215,196 | A | 2/1917 | Richardson et al. |
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,151,679 | A | 3/1939 | Blumer |
| 2,151,879 | A | 3/1939 | Weber |
| 2,314,098 | A | 3/1943 | Mcdonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |
| 2,586,045 | A | 2/1952 | Hoza |
| 2,606,076 | A | 8/1952 | Frazer |
| 2,606,078 | A | 8/1952 | Brock |
| 2,608,076 | A | 8/1952 | Owens |
| 2,608,078 | A | 8/1952 | Anderson |
| 2,641,004 | A | 6/1953 | Whiting et al. |
| 2,675,631 | A | 4/1954 | Doughty |
| 2,872,800 | A | 2/1959 | Davis et al. |
| 2,994,322 | A | 8/1961 | Cullen et al. |
| 3,015,170 | A | 1/1962 | Kramer |
| 3,016,631 | A | 1/1962 | Servin |
| 3,162,029 | A | 12/1964 | Laws et al. |
| 3,264,648 | A | 8/1966 | Sundberg et al. |
| 3,264,845 | A | 8/1966 | Rosén |
| 3,264,846 | A | 8/1966 | Pfrommer |
| 3,264,848 | A | 8/1966 | Führing |
| 3,307,379 | A | 3/1967 | Woolley et al. |
| 3,583,081 | A | 6/1971 | Hideo |
| 3,646,779 | A | 3/1972 | Nuber et al. |
| 3,694,940 | A | 10/1972 | Stohr |
| 3,704,474 | A | 12/1972 | Winkler |
| 3,766,566 | A | 10/1973 | Tadokoro |
| 3,778,856 | A | 12/1973 | Chriestie et al. |
| 3,798,801 | A | 3/1974 | Gros |
| 3,828,585 | A | 8/1974 | Thorneburg |
| 3,952,427 | A | 4/1976 | Von et al. |
| 3,972,086 | A | 8/1976 | Belli et al. |
| 4,027,402 | A | 6/1977 | Liu et al. |
| 4,031,586 | A | 6/1977 | Von et al. |
| 4,211,806 | A | 7/1980 | Civardi et al. |
| 4,232,458 | A | 11/1980 | Bartels |
| 4,255,949 | A | 3/1981 | Thorneburg |
| 4,258,480 | A | 3/1981 | Famolare, Jr. |
| 4,304,108 | A | 12/1981 | Chamlee |
| 4,317,292 | A | 3/1982 | Melton |
| 4,342,801 | A | 8/1982 | Gerlach et al. |
| 4,373,361 | A | 2/1983 | Thorneburg |
| 4,447,967 | A | 5/1984 | Zaino |
| 4,465,448 | A | 8/1984 | Aldridge |
| 4,577,419 | A | 3/1986 | Chassaing |
| 4,607,439 | A | 8/1986 | Kunihiko |
| 4,630,455 | A | 12/1986 | Lingenfelter |
| 4,737,396 | A | 4/1988 | Kamat |
| 4,750,339 | A | 6/1988 | Simpson et al. |
| 4,756,098 | A | 7/1988 | Boggia |
| 4,785,558 | A | 11/1988 | Shiomura |
| 4,813,158 | A | 3/1989 | Brown |
| 4,838,045 | A | 6/1989 | Cournoyer et al. |
| 4,891,958 | A | 1/1990 | Cournoyer et al. |
| 5,031,423 | A | 7/1991 | Ikenaga |
| 5,095,720 | A | 3/1992 | Tibbals, Jr. |
| 5,117,567 | A | 6/1992 | Berger |
| 5,118,569 | A | 6/1992 | Kuroda et al. |
| 5,152,025 | A | 10/1992 | Hirmas |
| 5,168,729 | A | 12/1992 | Metzner |
| 5,192,601 | A | 3/1993 | Neisler |
| 5,291,671 | A | 3/1994 | Caberlotto et al. |
| 5,307,283 | A | 4/1994 | Sawazaki et al. |
| 5,345,638 | A | 9/1994 | Nishida |
| 5,353,524 | A | 10/1994 | Brier |
| 5,356,701 | A | 10/1994 | Wei et al. |
| 5,371,957 | A | 12/1994 | Gaudio |
| 5,419,161 | A | 5/1995 | Bodenschatz et al. |
| 5,461,884 | A | 10/1995 | McCartney et al. |
| 5,470,625 | A | 11/1995 | Perrault |
| 5,511,323 | A | 4/1996 | Dahlgren |
| 5,572,860 | A | 11/1996 | Mitsumoto et al. |
| 5,575,090 | A | 11/1996 | Condini |
| 5,623,840 | A | 4/1997 | Roell |
| 5,729,918 | A | 3/1998 | Smets |
| 5,735,145 | A | 4/1998 | Pernick |
| 5,746,013 | A | 5/1998 | Fay, Sr. |
| 5,765,296 | A | 6/1998 | Ludemann et al. |
| 5,884,419 | A | 3/1999 | Davidowitz et al. |
| 5,890,381 | A | 4/1999 | Leeke et al. |
| 5,992,057 | A | 11/1999 | Monti |
| 5,996,189 | A | 12/1999 | Wang |
| 6,006,550 | A | 12/1999 | Singh |
| 6,029,376 | A | 2/2000 | Cass |
| 6,032,387 | A | 3/2000 | Johnson |
| 6,052,921 | A | 4/2000 | Oreck |
| 6,073,468 | A | 6/2000 | Wallace |
| 6,082,147 | A | 7/2000 | Rock et al. |
| 6,088,936 | A | 7/2000 | Bahl |
| 6,105,401 | A | 8/2000 | Chadeyron et al. |
| 6,112,437 | A | 9/2000 | Lovitt |
| 6,151,802 | A | 11/2000 | Reynolds |
| 6,164,095 | A | 12/2000 | Rock et al. |
| 6,170,175 | B1 | 1/2001 | Funk |
| 6,308,438 | B1 | 10/2001 | Throneburg et al. |
| 6,333,105 | B1 | 12/2001 | Tanaka et al. |
| 6,397,638 | B1 | 6/2002 | Roell |
| 6,401,364 | B1 | 6/2002 | Burt |
| 6,412,196 | B1 | 7/2002 | Gross |
| 6,558,784 | B1 | 5/2003 | Norton et al. |
| 6,745,395 | B2 | 6/2004 | Noble |
| 6,754,983 | B2 | 6/2004 | Hatfield et al. |
| 6,829,912 | B2 | 12/2004 | Rempp et al. |
| 6,837,078 | B1 | 1/2005 | Rock et al. |
| 6,910,288 | B2 | 6/2005 | Dua |

(56) References Cited

U.S. PATENT DOCUMENTS 6,922,917 B2 8/2005 Kerns et al.
6,931,762 B1 8/2005 Dua
D517,297 S 3/2006 Jones et al.
7,056,402 B2 6/2006 Koerwien et al.
7,174,750 B2 2/2007 Shirasaki et al.
7,235,504 B2 6/2007 Shirasaki et al.
7,293,371 B2 11/2007 Aveni
7,380,421 B1 6/2008 Liu
7,388,421 B1 6/2008 Destasi
7,441,348 B1 10/2008 Dawson
7,565,821 B2 7/2009 Park et al.
7,568,298 B2 8/2009 Kerns
7,682,219 B2 3/2010 Falla
8,448,474 B1 5/2013 Tatler et al.
8,522,577 B2 9/2013 Huffa
8,631,589 B2 1/2014 Dojan
8,800,172 B2 8/2014 Dua et al.
8,959,959 B1 * 2/2015 Podhajny ..... A43B 23/042 36/47
8,973,410 B1 3/2015 Podhajny
8,997,530 B1 * 4/2015 Podhajny ..... A43B 1/04 36/47
9,027,260 B2 5/2015 Dua et al.
9,072,335 B1 * 7/2015 Podhajny ..... A43B 1/04
9,078,488 B1 7/2015 Meir et al.
9,192,204 B1 11/2015 Liles et al.
9,375,046 B2 6/2016 Meir
9,681,704 B2 6/2017 Podhajny et al.
11,986,054 B2 * 5/2024 Henrichot ..... D04B 1/123
2002/0078599 A1 6/2002 Delgorgue et al.
2003/0126762 A1 7/2003 Tseng
2003/0191427 A1 10/2003 Jay et al.
2004/0181972 A1 9/2004 Csorba
2005/0115284 A1 6/2005 Dua
2005/0126042 A1 6/2005 Baier et al.
2005/0136768 A1 6/2005 Huang
2005/0160770 A1 7/2005 Ikeda et al.
2005/0193592 A1 9/2005 Dua et al.
2005/0268497 A1 12/2005 Alfaro et al.
2005/0273988 A1 12/2005 Christy
2006/0130359 A1 6/2006 Dua et al.
2006/0162187 A1 7/2006 Byrnes et al.
2007/0016999 A1 1/2007 Harber et al.
2007/0022627 A1 2/2007 Sokolowski et al.
2007/0068047 A1 3/2007 Alfaro et al.
2007/0101612 A1 5/2007 Kilgore
2007/0180730 A1 8/2007 Greene et al.
2007/0294920 A1 12/2007 Baychar
2008/0017294 A1 1/2008 Bailey et al.
2008/0078102 A1 4/2008 Kilgore et al.
2008/0110048 A1 5/2008 Dua et al.
2008/0110049 A1 5/2008 Sokolowski et al.
2008/0189830 A1 8/2008 Egglesfield
2008/0271265 A1 11/2008 Howley et al.
2008/0313939 A1 12/2008 Ardill
2009/0068908 A1 3/2009 Hinchcliff
2010/0043253 A1 2/2010 Dojan et al.
2010/0051132 A1 3/2010 Glenn
2010/0170651 A1 7/2010 Scherb et al.
2010/0175276 A1 7/2010 Dojan et al.
2010/0251564 A1 10/2010 Meschter
2011/0030244 A1 2/2011 Motawi et al.
2011/0041359 A1 * 2/2011 Dojan ..... A43C 1/00 36/47
2011/0078921 A1 4/2011 Greene et al.
2011/0113650 A1 5/2011 Hurd et al.
2011/0131831 A1 6/2011 Peyton et al.
2011/0277352 A1 11/2011 Diepenbrock et al.
2012/0017468 A1 1/2012 Dojan et al.
2012/0180340 A1 7/2012 Crowley et al.
2012/0222189 A1 9/2012 Sokolowski et al.
2012/0233882 A1 9/2012 Huffa et al.
2012/0234052 A1 9/2012 Huffa et al.
2012/0255201 A1 10/2012 Little
2012/0284935 A1 11/2012 Dojan et al.
2013/0019500 A1 1/2013 Greene
2013/0104423 A1 5/2013 Hatfield et al.
2013/0145652 A1 6/2013 Podhajny et al.
2013/0239625 A1 9/2013 Meir et al.
2013/0318837 A1 12/2013 Dua et al.
2014/0068968 A1 3/2014 Podhajny et al.
2014/0137433 A1 5/2014 Craig
2014/0196311 A1 7/2014 Follet et al.
2014/0196316 A1 7/2014 Follet
2014/0237861 A1 8/2014 Podhajny
2014/0245632 A1 9/2014 Podhajny et al.
2014/0245633 A1 9/2014 Podhajny
2014/0245634 A1 9/2014 Podhajny
2014/0245638 A1 9/2014 Seamarks et al.
2014/0310984 A1 10/2014 Tamm et al.
2014/0338226 A1 11/2014 Zavala
2015/0047225 A1 2/2015 Zavala et al.
2015/0059209 A1 3/2015 Dekovic et al.
2015/0250256 A1 * 9/2015 Podhajny ..... A43B 23/042 36/83
2015/0272275 A1 10/2015 Dojan et al.
2016/0029736 A1 2/2016 Meir
2016/0029744 A1 2/2016 Dojan
2016/0058098 A1 3/2016 Cross et al.
2016/0088894 A1 3/2016 Meir et al.
2016/0088899 A1 3/2016 Liles et al.
2016/0090670 A1 3/2016 Meir
2016/0108566 A1 4/2016 Tseng et al.
2016/0340812 A1 11/2016 Meir
2017/0238644 A1 8/2017 Meir et al.
2018/0049510 A1 2/2018 Meir et al.
2018/0064211 A1 3/2018 Henrichot et al.
2018/0179676 A1 6/2018 Takahashi et al.
2019/0142101 A1 5/2019 Meir et al.
2019/0142102 A1 5/2019 Meir et al.
2019/0226129 A1 7/2019 Meir
2020/0077745 A1 3/2020 Henrichot et al.
2021/0047760 A1 2/2021 Meir et al.
2021/0198819 A1 7/2021 Meir
2022/0053883 A1 2/2022 Henrichot et al.

FOREIGN PATENT DOCUMENTS

CN 1456724 A 11/2003
CN 201058526 Y 5/2008
CN 201440974 U 4/2010
CN 102271548 A 12/2011
CN 102405133 A 4/2012
CN 202187126 U 4/2012
CN 102497793 A 6/2012
CN 102762121 A 10/2012
CN 202536202 U 11/2012
CN 202950101 U 5/2013
CN 103179873 A 6/2013
CN 103200834 A 7/2013
CN 103462296 A 12/2013
CN 103829460 A 6/2014
CN 103841851 A 6/2014
CN 103844428 A 6/2014
CN 103857307 A 6/2014
CN 205030620 U 2/2016
DE 0870963 C 3/1953
DE 1084173 B 6/1960
DE 19738433 A1 4/1998
DE 19728846 A1 1/1999
DE 19728848 A1 1/1999
EP 0279950 A2 8/1988
EP 0372370 A2 6/1990
EP 0448714 A1 10/1991
EP 0728860 A1 8/1996
EP 0758693 A1 2/1997
EP 0898002 A2 2/1999
EP 1233091 A1 8/2002
EP 1437057 A1 7/2004
EP 1563752 A1 8/2005
EP 1602762 A1 12/2005
EP 1972706 A1 9/2008
EP 2520188 A1 11/2012
EP 2716177 A2 4/2014

(56) References Cited

FOREIGN PATENT DOCUMENTS

| | | | |
|---|---|---|---|
| FR | 2171172 | A1 | 9/1973 |
| FR | 2571387 | A1 | 4/1986 |
| GB | 0538865 | A | 8/1941 |
| GB | 1461928 | A | 1/1977 |
| GB | 2018837 | A | 10/1979 |
| GB | 1603487 | A | 11/1981 |
| JP | 53-120541 | | 6/1951 |
| JP | 38-017917 | | 8/1988 |
| JP | 01-007917 | Y2 | 3/1989 |
| JP | 06-113905 | A | 4/1994 |
| JP | 07-049614 | A | 2/1995 |
| JP | 08-109553 | A | 4/1996 |
| JP | 10-080304 | A | 3/1998 |
| JP | 10-298847 | A | 11/1998 |
| JP | 11-302943 | A | 11/1999 |
| JP | 2000-502934 | A | 3/2000 |
| JP | 3817917 | B2 | 9/2006 |
| JP | 2012-512698 | A | 6/2012 |
| JP | 2013-502300 | A | 1/2013 |
| JP | 2013-252433 | A | 12/2013 |
| JP | 2014-508009 | A | 4/2014 |
| KR | 10-2011-0038679 | A | 4/2011 |
| KR | 10-2034295 | B1 | 10/2019 |
| NL | 7304678 | A | 10/1974 |
| TW | 162299 | | 7/1991 |
| TW | 311119 | B | 7/1997 |
| TW | 503275 | B | 9/2002 |
| TW | I723400 | B | 4/2021 |
| WO | 90/03744 | A1 | 4/1990 |
| WO | 00/32861 | A1 | 6/2000 |
| WO | 02/04726 | A1 | 1/2002 |
| WO | 02/31247 | A1 | 4/2002 |
| WO | 2010/014300 | A1 | 2/2010 |
| WO | 2010/080182 | A1 | 7/2010 |
| WO | 2012/125473 | A2 | 9/2012 |
| WO | 2013/011339 | A1 | 1/2013 |
| WO | 2013/113339 | A1 | 8/2013 |
| WO | 2014/134244 | A1 | 9/2014 |
| WO | 2016/053805 | A1 | 4/2016 |

OTHER PUBLICATIONS

Exhibit No. 2008, received in PTAB IPR No. 2019-01060, dated Sep. 5, 2019, 14 pages.
Exhibit No. 2008, received in PTAB IPR No. 2019-01190, dated Sep. 19, 2019, 14 pages.
Exhibit No. 2009, received in PTAB IPR No. 2019-01060, dated Sep. 5, 2019, 65 pages.
Exhibit No. 2009, received in PTAB IPR No. 2019-01190, dated Sep. 19, 2019, 33 pages.
Exhibit No. 2010, received in PTAB IPR No. 2019-01060, dated Sep. 5, 2019, 42 pages.
Exhibit No. 2010, received in PTAB IPR No. 2019-01190, dated Sep. 19, 2019, 42 pages.
Exhibit No. 2011, received in PTAB IPR No. 2019-01060, dated Sep. 5, 2019, 2 pages.
Exhibit No. 2011, received in PTAB IPR No. 2019-01190, dated Sep. 19, 2019, 2 pages.
Exhibit No. 2012, received in PTAB IPR No. 2019-01060, dated Sep. 5, 2019, 2 pages.
Exhibit No. 2012, received in PTAB IPR No. 2019-01190, dated Sep. 19, 2019, 2 pages.
Exhibit No. 2013, received in PTAB IPR No. 2019-01060, dated Sep. 5, 2019, 10 pages.
Exhibit No. 2013, received in PTAB IPR No. 2019-01190, dated Sep. 19, 2019, 10 pages.
Exhibit No. 2014, received in PTAB IPR No. 2019-01060, dated Sep. 5, 2019, 12 pages.
Exhibit No. 2014, received in PTAB IPR No. 2019-01190, dated Sep. 19, 2019, 12 pages.
Exhibit No. 3, received in PTAB IPR No. 2019-01060, dated May 23, 2019, 4 pages.
Exhibit No. 3, received in PTAB IPR No. 2019-01190, dated Jun. 14, 2019, 5 pages.
Exhibit No. 4, received in PTAB IPR No. 2019-01060, dated May 23, 2019, 4 pages.
Exhibit No. 4, received in PTAB IPR No. 2019-01190, dated Jun. 14, 2019, 4 pages.
Exhibit No. 5, received in PTAB IPR No. 2019-01060, mailed on Jun. 5, 2019, 5 pages.
Exhibit No. 5, received in PTAB IPR No. 2019-01190, dated Jun. 19, 2019, 5 pages.
Exhibit No. 6, received in PTAB IPR No. 2019-01060, dated Jun. 14, 2019, 5 pages.
Exhibit No. 6, received in PTAB IPR No. 2019-01190, dated Sep. 19, 2019, 36 pages.
Exhibit No. 7, received in PTAB IPR No. 2019-01060, dated Sep. 5, 2019, 69 pages.
Exhibit No. 7, received in PTAB IPR No. 2019-01190, dated Dec. 2, 2019, 8 pages.
Exhibit No. 8, received in PTAB IPR No. 2019-01060, dated Dec. 2, 2019, 8 pages.
Exhibit No. 9, received in PTAB IPR No. 2019-01190, dated Dec. 2, 2019, 4 pages.
Spencer, David J. , "Knitting Technology, A comprehensive handbook and practical guide", Third Edition ; Woodhead Publishing Limited, Abington Hall, Abington Cambridge, CB1 6AH, England, ISBN 1855733331, Exhibit 1012 in IPR2013-00067, Nov. 28, 2012, 413 pages.
Non-Final Office Action received for U.S. Appl. No. 18/302,621, mailed on Oct. 1, 2024, 9 pages.
Office Action received for European Application No. 15775585.1, mailed on Jun. 26, 2024, 4 pages.
Declaration of Dr. Edward C. Frederick from the US Patent and Trademark Office Inter Partes Review of U.S. Pat. No. 7,347,011, 178 pages.
Eberle et al., "Clothing Technology", Sixth German Edition and Third English Edition, Petitioner adidas AG—Exhibit 1013, 2002, 3 pages.
Exhibit No. 1, received in PTAB IPR No. 2019-01060, dated May 3, 2019, 81 pages.
Exhibit No. 1, received in PTAB IPR No. 2019-01190, dated Jun. 11, 2019, 39 pages.
Exhibit No. 10, received in PTAB IPR No. 2019-01060, dated Dec. 2, 2019, 4 pages.
Exhibit No. 10, received in PTAB IPR No. 2019-01190, dated Dec. 3, 2019, 4 pages.
Exhibit No. 1001, received in PTAB IPR No. 2019-01060, dated May 3, 2019, 39 pages.
Exhibit No. 1001, received in PTAB IPR No. 2019-01190, dated Jun. 11, 2019, 39 pages.
Exhibit No. 1002, received in PTAB IPR No. 2019-01060, dated May 3, 2019, 39 pages.
Exhibit No. 1002, received in PTAB IPR No. 2019-01190, dated Jun. 11, 2019, 39 pages.
Exhibit No. 1003 (Part 1), received in PTAB IPR No. 2019-01190, dated Jun. 11, 2019, 664 pages.
Exhibit No. 1003 (Part I), received in PTAB IPR No. 2019-01060, dated May 3, 2019, 664 pages.
Exhibit No. 1003 (Part II), received in PTAB IPR No. 2019-01060, dated May 3, 2019, 675 pages.
Exhibit No. 1003 (Part II), received in PTAB IPR No. 2019-01190, dated Jun. 11, 2019, 675 pages.
Exhibit No. 1004, received in PTAB IPR No. 2019-01060, dated May 3, 2019, 27 pages.
Exhibit No. 1004, received in PTAB IPR No. 2019-01190, dated Jun. 11, 2019, 27 pages.
Exhibit No. 1005, received in PTAB IPR No. 2019-01060, dated May 3, 2019, 4 pages.
Exhibit No. 1005, received in PTAB IPR No. 2019-01190, dated Jun. 11, 2019, 4 pages.
Exhibit No. 1006, received in PTAB IPR No. 2019-01060, dated May 3, 2019, 16 pages.
Exhibit No. 1006, received in PTAB IPR No. 2019-01190, dated Jun. 11, 2019, 16 pages.

(56) References Cited

OTHER PUBLICATIONS

Exhibit No. 1007, received in PTAB IPR No. 2019-01060, dated May 3, 2019, 90 pages.
Exhibit No. 1007, received in PTAB IPR No. 2019-01190, dated Jun. 11, 2019, 90 pages.
Exhibit No. 1008, received in PTAB IPR No. 2019-01060, dated May 3, 2019, 3 pages.
Exhibit No. 1008, received in PTAB IPR No. 2019-01190, dated Jun. 11, 2019, 3 pages.
Exhibit No. 1009, received in PTAB IPR No. 2019-01060, dated May 3, 2019, 1 page.
Exhibit No. 1009, received in PTAB IPR No. 2019-01190, dated Jun. 11, 2019, 1 page.
Exhibit No. 1010, received in PTAB IPR No. 2019-01060, dated May 3, 2019, 4 pages.
Exhibit No. 1010, received in PTAB IPR No. 2019-01190, dated Jun. 11, 2019, 4 pages.
Exhibit No. 1011, received in PTAB IPR No. 2019-01060, dated May 3, 2019, 1 page.
Exhibit No. 1011, received in PTAB IPR No. 2019-01190, dated Jun. 11, 2019, 1 page.
Exhibit No. 11, received in PTAB IPR No. 2019-01060, dated Dec. 3, 2019, 4 pages.
Exhibit No. 11, received in PTAB IPR No. 2019-01190, dated Dec. 4, 2019, 4 pages.
Exhibit No. 12, received in PTAB IPR No. 2019-01060, dated Dec. 4, 2019, 4 pages.
Exhibit No. 12, received in PTAB IPR No. 2019-01190, dated Dec. 6, 2019, 2 pages.
Exhibit No. 13, received in PTAB IPR No. 2019-01060, dated Dec. 6, 2019, 2 pages.
Exhibit No. 2, received in PTAB IPR No. 2019-01060, dated May 3, 2019, 5 pages.
Exhibit No. 2, received in PTAB IPR No. 2019-01190, dated Jun. 11, 2019, 5 pages.
Exhibit No. 2001, received in PTAB IPR No. 2019-01060, dated Sep. 5, 2019, 47 pages.
Exhibit No. 2001, received in PTAB IPR No. 2019-01190, dated Sep. 19, 2019, 26 pages.
Exhibit No. 2002, received in PTAB IPR No. 2019-01060, dated Sep. 5, 2019, 2 pages.
Exhibit No. 2002, received in PTAB IPR No. 2019-01190, dated Sep. 19, 2019, 2 pages.
Exhibit No. 2003, received in PTAB IPR No. 2019-01060, dated Sep. 5, 2019, 8 pages.
Exhibit No. 2003, received in PTAB IPR No. 2019-01190, dated Jun. 11, 2019, 8 pages.
Exhibit No. 2004, received in PTAB IPR No. 2019-01060, dated Sep. 5, 2019, 4 pages.
Exhibit No. 2004, received in PTAB IPR No. 2019-01190, dated Sep. 19, 2019, 4 pages.
Exhibit No. 2005, received in PTAB IPR No. 2019-01060, dated Sep. 5, 2019, 43 Pages.
Exhibit No. 2005, received in PTAB IPR No. 2019-01190, dated Sep. 19, 2019, 43 Pages.
Exhibit No. 2006, received in PTAB IPR No. 2019-01060, dated Sep. 5, 2019, 7 pages.
Exhibit No. 2006, received in PTAB IPR No. 2019-01190, dated Sep. 19, 2019, 7 pages.
Exhibit No. 2007, received in PTAB IPR No. 2019-01060, dated Sep. 5, 2019, 2 pages.
Notice of Allowance received for U.S. Appl. No. 18/302,621, mailed on Mar. 13, 2025, 5 pages.
Non-Final Office Action received for U.S. Appl. No. 18/541,853, mailed on May 29, 2025, 7 pages.
Notice of Allowance received for U.S. Appl. No. 18/302,621, mailed on Jun. 17, 2025, 2 pages.

* cited by examiner

ARTICLE OF FOOTWEAR UPPER INCORPORATING A TEXTILE COMPONENT WITH TENSILE ELEMENTS

CROSS-REFERENCE TO RELATED APPLICATIONS AND PRIORITY CLAIM

This non-provisional patent application is a continuation of co-pending U.S. patent application Ser. No. 17/517,269, filed on Nov. 2, 2021, and titled "Article of Footwear Upper Incorporating a Textile Component with Tensile Elements," which is a continuation of U.S. patent application Ser. No. 16/686,413, filed Nov. 18, 2019, and titled "Article of Footwear Upper Incorporating a Textile Component with Tensile Elements," now issued as U.S. Pat. No. 11,197,518, which is a continuation of U.S. patent application Ser. No. 15/807,116, filed Nov. 8, 2017, and titled "Article of Footwear Upper Incorporating a Textile Component with Tensile Elements," now issued as U.S. Pat. No. 10,477,920, which is a continuation of U.S. patent application Ser. No. 14/880,707, filed Oct. 12, 2015, and titled "Article of Footwear Upper Incorporating a Textile Component with Tensile Elements," now issued as U.S. Pat. No. 9,826,798, which is a continuation of U.S. patent application Ser. No. 14/535,648, filed Nov. 7, 2014, and titled "Article of Footwear Upper Incorporating a Textile Component with Tensile Elements," now issued as U.S. Pat. No. 9,192,204, which claims the benefit of U.S. provisional patent app. No. 62/057,264 filed on Sep. 30, 2014, and titled "Article of Footwear Incorporating a Knitted Component with Inlaid Tensile Elements and Method of Assembly," and of U.S. provisional patent app. No. 62/057,650, filed Sep. 30, 2014, and titled "Article of Footwear Upper Incorporating a Textile Component with Tensile Elements." The aforementioned applications are all incorporated herein by reference in the entirety.

BACKGROUND

The present invention relates generally to articles of footwear, and, in particular, to articles with textile components.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear.

A variety of material elements are conventionally used in manufacturing the upper. In athletic footwear, for example, the upper may have multiple layers that include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements used in the upper, therefore, waste may be decreased while increasing the manufacturing efficiency and recyclability of the upper.

SUMMARY

An article of footwear is disclosed that is configured to receive a foot of a wearer and that is configured to support a securement device. The securement device is configured to selectively vary a fit of the article of footwear on the foot. The article of footwear includes a sole structure and an upper with a lower portion that is attached to the sole structure. The upper further includes a heel region, a first side, and a second side. The upper further includes a textile component that includes a textile element that at least partially defines the heel region, the first side, and the second side of the upper. The textile component further includes a tensile element that is attached to the textile element. The tensile element defines a first segment disposed on the first side of the upper. The first segment of the tensile element is configured to attach the securement device to the textile element on the first side of the upper. The tensile element further includes a second segment that is disposed proximate the lower portion of the upper on the second side. The second segment is fixed relative to the lower portion of the upper on the second side. The tensile element further includes an intermediate segment that extends continuously from the first segment, across the heel region, to the second segment. The tensile element is configured to transfer at least a portion of an input force applied to the first side of the upper across the heel region, to the lower portion of the upper on the second side.

An article of footwear is also disclosed that is configured to receive a foot of a wearer and that is configured to support a securement device. The securement device is configured to selectively vary a fit of the article of footwear on the foot. The article of footwear includes a sole structure and an upper that defines a cavity configured to receive the foot. The upper includes a lower portion that is attached to the sole structure. The upper includes a heel region, a first side, and a second side. The upper further includes a knitted component formed of unitary knit construction. The upper defines an opening configured to provide passage of the foot into the cavity. The upper further includes a throat that is disposed between the first side and the second side. The throat extends away from the opening. The knitted component of the upper includes a knit element that at least partially defines the heel region, the first side, and the second side of the upper. The knitted component also includes a first tensile element that is formed of unitary knit construction with the knit element. The first tensile extends continuously from the throat on the first side, across the heel region, to the lower portion on the second side. Moreover, the knitted component includes a second tensile element that is formed of unitary knit construction with the knit element. The second tensile element extends continuously from the throat on the second side to the lower portion on the second side. The first tensile element defines at least one first segment that is disposed at the throat on the first side and that is configured to receive the securement device on the first side. The second tensile element defines at least one second segment that is disposed at the throat on the second side and that is configured to receive the securement device on the second side.

Additionally, a knitted component is disclosed that is configured to define an upper for an article of footwear. The upper includes a forefoot region, a heel region, a first side that extends between the forefoot and heel regions, and a second side that extends between the forefoot and heel regions. The knitted component includes a knit element and a tensile stand formed of unitary knit construction with the knit element. The knit element includes a front surface and a back surface. The knit element includes a first end and a second end. The knit element further includes a tubular rib structure that extends generally between the first end and the second end. The tubular rib structure includes an open end disposed proximate the second end. The tensile element includes a first segment that is received within the tubular rib structure. The tensile element further includes a second segment that extends from the first segment and out of the open end. The tensile element further includes a third segment that extends from the first segment, out of the knit element from the front surface, and back into the knit element through the front surface. The first end of the knit element is configured to be fixed at the second side of the upper. The second end of the knit element is configured to be fixed at the second side of the upper. The first segment is configured to extend through the tubular rib structure from the first side, across the heel region, to the second side of the upper. The second segment is configured to be fixed relative to the knit element on the second side of the upper. The first segment is configured to be disposed on the first side of the upper.

Moreover, a method of forming an upper for an article of footwear is disclosed. The method includes forming a textile component that includes a textile element and a tensile element. The textile element includes a front surface and a back surface, a first end and a second end, and a tubular rib structure that extends generally between the first end and the second end. The method further includes routing the tensile element such that a first segment of the tensile element is received within the tubular rib structure. Moreover, the method includes routing the tensile element such that a second segment of the tensile element extends from the first segment and out of an open end of the tubular rib structure. Additionally, the method includes routing the tensile element such that a third segment of the tensile element extends from the first segment, out of the textile element from the front surface, and back into the textile element through the front surface. Furthermore, the method includes assembling the textile component to define a first side, a forefoot region, a second side, and a heel region of the upper. Assembling the textile component includes wrapping the textile component from the second side, across the forefoot region, across the first side, across the heel region, and back to the second side. Assembling the textile component also includes providing the first end of the textile element at the second side of the upper, and providing the second end of the textile element at the second side of the upper. Moreover, assembling the textile component includes extending the first segment through the tubular rib structure from the first side, across the heel region, to the second side of the upper. Furthermore, assembling the textile component includes fixing the second segment relative to the textile element on the second side of the upper. Still further, assembling the textile component includes providing the first segment on the first side of the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
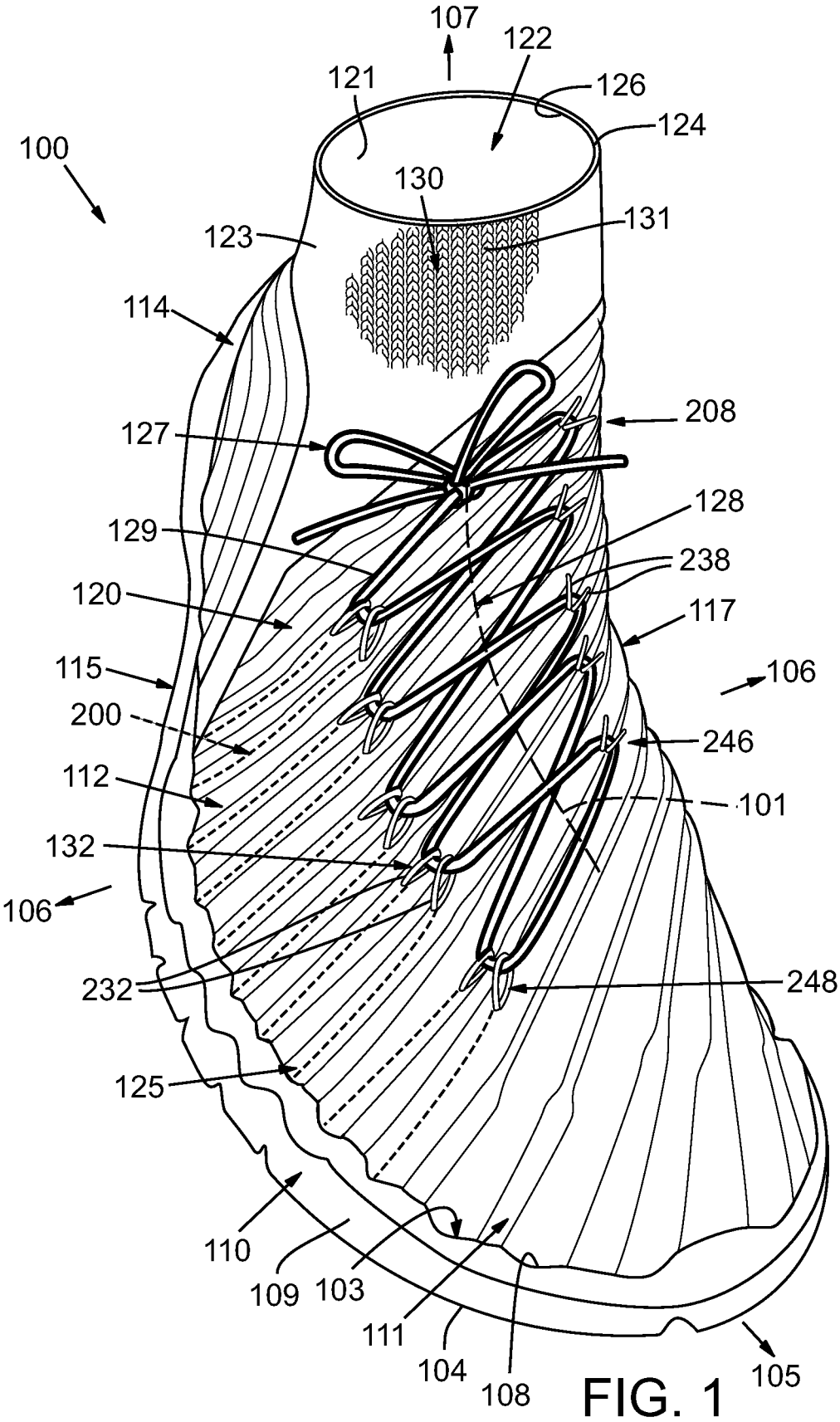
FIG. 1 is a front perspective view of an article of footwear according to exemplary embodiments of the present disclosure.

The following discussion and accompanying figures disclose a variety of concepts relating to articles of footwear. Footwear can include an upper that is at least partially defined by a textile component. The textile component can provide advantageous fit and flexibility for the wearer's foot. For example, in some embodiments, the textile component can conform to the wearer's foot and can flex to support movement of the wearer's foot.

Additionally, the textile component can include a tensile element that transfers forces across the textile component for supporting the wearer's foot. The tensile element can also affect flexure and/or stretching of the upper. For example, the tensile element can limit excessive flexing and/or stretching of the textile element in some embodiments.

Moreover, in some embodiments, an input force applied to one side of upper can be transferred and/or distributed to the opposite side of upper. In some embodiments, this can cause upper to flex generally in an inward direction to compress the foot when running, jumping, changing directions, or during other ambulatory activities. As such, the upper can be securely fit to the wearer's foot and can support a wide variety of activities.

General Discussion of Article of Footwear

Referring initially to FIGS. 1-6, an article of footwear 100 is illustrated according to exemplary embodiments. Generally, footwear 100 can include a sole structure 110 and an upper 120. Upper 120 can receive the wearer's foot and secure footwear 100 to the wearer's foot. Sole structure 110 can extend underneath upper 120 and support wearer.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone.

Footwear 100 can also include a lateral side 115 and a medial side 117. Lateral side 115 and medial side 117 can extend through forefoot region 111, midfoot region 112, and heel region 114 in some embodiments. Lateral side 115 and medial side 117 can correspond with opposite sides of footwear 100. More particularly, lateral side 115 can correspond with an outside area of the wearer's foot (i.e. the surface that faces away from the other foot), and medial side 117 can correspond with an inside area of the wearer's foot (i.e., the surface that faces toward the other foot).

Forefoot region 111, midfoot region 112, heel region 114, lateral side 115, and medial side 117 are not intended to demarcate precise areas of footwear 100. Rather, forefoot region 111, midfoot region 112, heel region 114, lateral side 115, and medial side 117 are intended to represent general areas of footwear 100 to aid in the following discussion.

Footwear 100 can also extend along various directions. For example, as shown in FIGS. 1-6, footwear 100 can extend along a longitudinal direction 105, a transverse direction 106, and a vertical direction 107. Longitudinal direction 105 can extend generally between heel region 114 and forefoot region 111. Transverse direction 106 can extend generally between lateral side 115 and medial side 117. Also, vertical direction 107 can extend generally between upper 120 and sole structure 110. It will be appreciated that longitudinal direction 105, transverse direction 106, and vertical direction 107 are included in the following discussion for reference purposes, to explain relative positions of different features of footwear 100, and to aid in the following discussion.

Embodiments of sole structure 110 will now be discussed with reference to FIGS. 1-4 and 6. Sole structure 110 can be secured to upper 120 and can extend between the wearer's foot and the ground when footwear 100 is worn. Sole structure 110 can be a uniform, one-piece member in some embodiments. Alternatively, sole structure 110 can include multiple components, such as an outsole and a midsole in some embodiments.

Also, sole structure 110 can include a ground-engaging surface 104. Ground-engaging surface 104 can also be referred to as a ground-contacting surface. Furthermore, sole structure 110 can include an upper surface 108 that faces the upper 120. Stated differently, upper surface 108 can face in an opposite direction from the ground-engaging surface 104. Moreover, sole structure 110 can include a peripheral side surface 109. In some embodiments, peripheral side surface 109 can extend in the vertical direction 107 between upper surface 108 and ground engaging surface 104. In some cases, peripheral side surface 109 can extend at least partially around an outer periphery of footwear 100, including extending through at least a portion of one or more of heel region 114, midfoot region 112, and forefoot region 111. Also, in some embodiments, peripheral side surface 109 can extend continuously from heel region 114, along medial side 117, across forefoot region 111, along lateral side 115, and back to heel region 114. In various embodiments, the height of peripheral side surface 109 along the vertical direction 107 may vary. In some cases, the height may be substantially similar along a majority of peripheral side surface 109. In other cases, portions of peripheral side surface 109 may be larger or smaller across different portions of peripheral side surface 109 extending through one or more of heel region 114, midfoot region 112, or forefoot region 111.

Moreover, sole structure 110 can include an attachment area 103 where sole structure 110 is attached to upper 120. As shown, attachment area 103 can be defined on upper surface 108, proximate peripheral side surface 109. In additional embodiments, attachment area 103 can be defined on peripheral side surface 109.

In some embodiments, sole structure 110 can include a midsole and an outsole. Midsole can include a resiliently compressible material, fluid-filled bladders, and the like. As such, midsole can cushion the wearer's foot and attenuate impact and other forces when running, jumping, and the like. Outsole can be secured to the midsole and can include a wear resistant material, such as rubber and the like. Outsole can also include tread and other traction-enhancing features for ground engaging surface 104.

Embodiments of upper 120 will now be discussed in greater detail with reference to FIGS. 1-6. As shown, upper 120 can define a void 122 that receives a foot of the wearer. Stated differently, upper 120 can define an interior surface 121 that defines void 122, and upper 120 can define an exterior surface 123 that faces in a direction opposite interior surface 121. When the wearer's foot is received within void 122, upper 120 can at least partially enclose and encapsulate the wearer's foot. Thus, upper 120 can extend about forefoot region 111, lateral side 115, heel region 114, and medial side 117 in some embodiments.

Upper 120 can additionally include a lower portion 125 that is attached to sole structure 110. As such, lower portion 125 of upper 125 can be fixed to attachment area 103 of sole structure 110. In some embodiments, lower portion 125 of upper 120 can be defined on a lower periphery of upper 120 and can extend about the wearer's foot. Also, in some embodiments, lower portion 125 of upper 120 can extend between the medial side 117 and the lateral side 115 and/or between the heel region 114 and the forefoot region 11, underneath the wearer's foot.

Upper 120 can also include a collar 124. Collar 124 can include a collar opening 126 that is configured to allow passage of the wearer's foot during insertion or removal of the foot from the void 122.

Upper 120 can also include a throat 128. Throat 128 can extend along a throat axis 101 from collar opening 126 toward forefoot region 111. Throat 128 can extend over the foot and can be defined between the first lateral side 115 and the medial side 117. Dimensions of throat 128 can be varied to change the width of footwear 100 between lateral side 115 and medial side 117. Thus, throat 128 can affect fit and comfort of article of footwear 100.

In some embodiments, such as the embodiment of FIGS. 1-6, throat 128 can be a "closed" throat 128, in which upper 120 is substantially continuous and uninterrupted between lateral side 115 and medial side 117. In other embodiments, throat 128 can include a throat opening between lateral side 115 and medial side 117. In these latter embodiments, footwear 100 can include a tongue that is disposed within throat opening. For example, in some embodiments, the tongue can be attached at its forward end to forefoot region 111, and the tongue can be detached from lateral side 115 and medial side 117. Accordingly, the tongue can substantially fill the throat opening.

Footwear 100 can additionally include a securement device 127 as shown in FIGS. 1-6. Securement device 127 can be used by the wearer to adjust the dimensions of the footwear 100. For example, securement device 127 can be used by the wearer to selectively vary the girth, or width of footwear 100. Accordingly, securement device 127 can be configured to selectively vary the fit of the article of footwear 100 on the wearer's foot. Securement device 127 can be of any suitable type and can be coupled to footwear 100 at any suitable location. For example, in some embodiments represented in FIGS. 1-6, securement device 127 can include a shoelace 129 that is secured to both lateral side 115 and medial side 117. In other embodiments, securement device 127 can include a strap, a buckle, a hook, a drawstring, a spool, or any other device. By tensioning securement device 127, lateral side 115 and medial side 117 can be pulled toward each other to tighten footwear 100 onto the wearer's foot. As such, footwear 100 can be tightly secured to the wearer's foot. By reducing tension in securement device 127, footwear 100 can be loosened, and footwear 100 can be easier to put on or remove from the wearer's foot.

Many conventional footwear uppers are formed from multiple material elements that are joined through stitching or bonding, for example. In contrast, at least a portion of upper 120 can be formed and defined by a textile component, such as a knitted component 130. Knitted component 130 can be formed of unitary knit construction.

In other embodiments, upper 120 can be at least partially defined by a structure that is similar to knitted component 130, but that is formed using a different material. For example, upper 120 can be defined by other types of textile components, such as a woven structure. It further embodiments, upper 120 can be formed and defined by non-textile materials, such as leather, polymer, or other types of materials. Moreover, upper 120 can be defined by a structure that is assembled from two or more pieces that are joined together (i.e., a non-unitary structure).

In some embodiments, knitted component 130 can define at least a portion of void 122 within upper 120. Also, in some embodiments, knitted component 130 can define at least a portion of exterior surface 123. Furthermore, in some embodiments, knitted component 130 can define at least a portion of interior surface 121 of upper 120. Additionally, in some embodiments, knitted component 130 can define a substantial portion of heel region 114, midfoot region 112, forefoot region 111, medial side 117, and lateral side 115 of upper 120. Thus, knitted component 130 can encompass the wearer's foot in some embodiments. Also, in some embodiments, knitted component 130 can compress the wearer's foot to secure to the wearer's foot.

Thus, upper 120 can be constructed with a relatively low number of material elements. This can decrease waste while also increasing the manufacturing efficiency and recyclability of upper 120. Additionally, knitted component 130 of upper 120 can incorporate a smaller number of seams or other discontinuities. This can further increase manufacturing efficiency of footwear 100. Moreover, interior surface 121 of upper 120 can be substantially smooth and uniform to enhance the overall comfort of footwear 100

As stated, knitted component 130 can be formed of unitary knit construction. As used herein and in the claims, a knitted component (e.g., knitted component 130, or other knitted components described herein) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 130 may be joined to each other (e.g., edges of knitted component 100 being joined together) following the knitting process, knitted component 130 remains formed of unitary knit construction because it is formed as a one-piece knit element. Moreover, knitted component 130 remains formed of unitary knit construction when other elements (e.g., a lace, logos, trademarks, placards with care instructions and material information, structural elements) are added following the knitting process.

In different embodiments, any suitable knitting process may be used to produce knitted component 130 formed of unitary knit construction, including, but not limited to a flat knitting process, such as warp knitting or weft knitting, as well as a circular knitting process, or any other knitting process suitable for providing a knitted component. Examples of various configurations of knitted components and methods for forming knitted component 130 with unitary knit construction are disclosed in U.S. Pat. No. 6,931,762 to Dua; and U.S. Pat. No. 7,347,011 to Dua, et al., the disclosure of each being incorporated by reference in its entirety. Knitted component 130 can also include one or more features disclosed in U.S. Provisional Patent Application No. 62/057,264, filed on Sep. 30, 2014, which was filed as U.S. Nonprovisional patent application Ser. No. 14/535,413 on Nov. 7, 2014, and entitled "Article of Footwear Incorporating A Knitted Component with Inlaid Tensile Elements and Method of Assembly", the disclosure of which applications are hereby incorporated by reference in its entirety.

Knitted component 130 can generally include a knit element 131. Knit element 131 can also be referred to as a "textile element." Knitted component 130 can also generally include at least one tensile element 132. Knit element 131 and tensile element 132 can be formed of unitary knit construction.

As will be discussed, knit element 131 can define relatively large areas of upper 120. The knit construction of knit element 131 can provide the upper with advantageous flexibility, elasticity, resiliency, and stretchiness in some embodiments. Accordingly, the knit element 131 and the upper 120 can be comfortable to wear. Also, the knit element 131 can allow the wearer's foot to flex and move within the upper 120 without compromising comfort. Moreover, the tensile elements 132 can be routed across knit element 131 in predetermined areas to provide increased support and strength to those areas. Additionally, the tensile elements 132 can transfer forces and/or distribute forces across the knit element 131 in a predetermined manner. Accordingly, forces input to the knit element 131 at one area can transfer across the knit element to another area. In some embodiments, this can cause the knit element 131 and, thus, the upper 120 to compress against the wearer's foot for added support and comfort during running, jumping, changing directions, or other movements.

Embodiments of Knit Element

Knit element 131 will now be discussed in greater detail according to exemplary embodiments. Knit element 131 is shown in a disassembled, substantially flat position in FIG. 7 and in detail in FIGS. 8-10 according to some embodiments of the present disclosure. Knit element 131 is shown in the process of being assembled into upper 120 for article of footwear 100 in FIGS. 11-16. As shown, in some embodiments, knit element 131 can define a majority of knitted component 130 and upper 120.

Figures 7, 8:
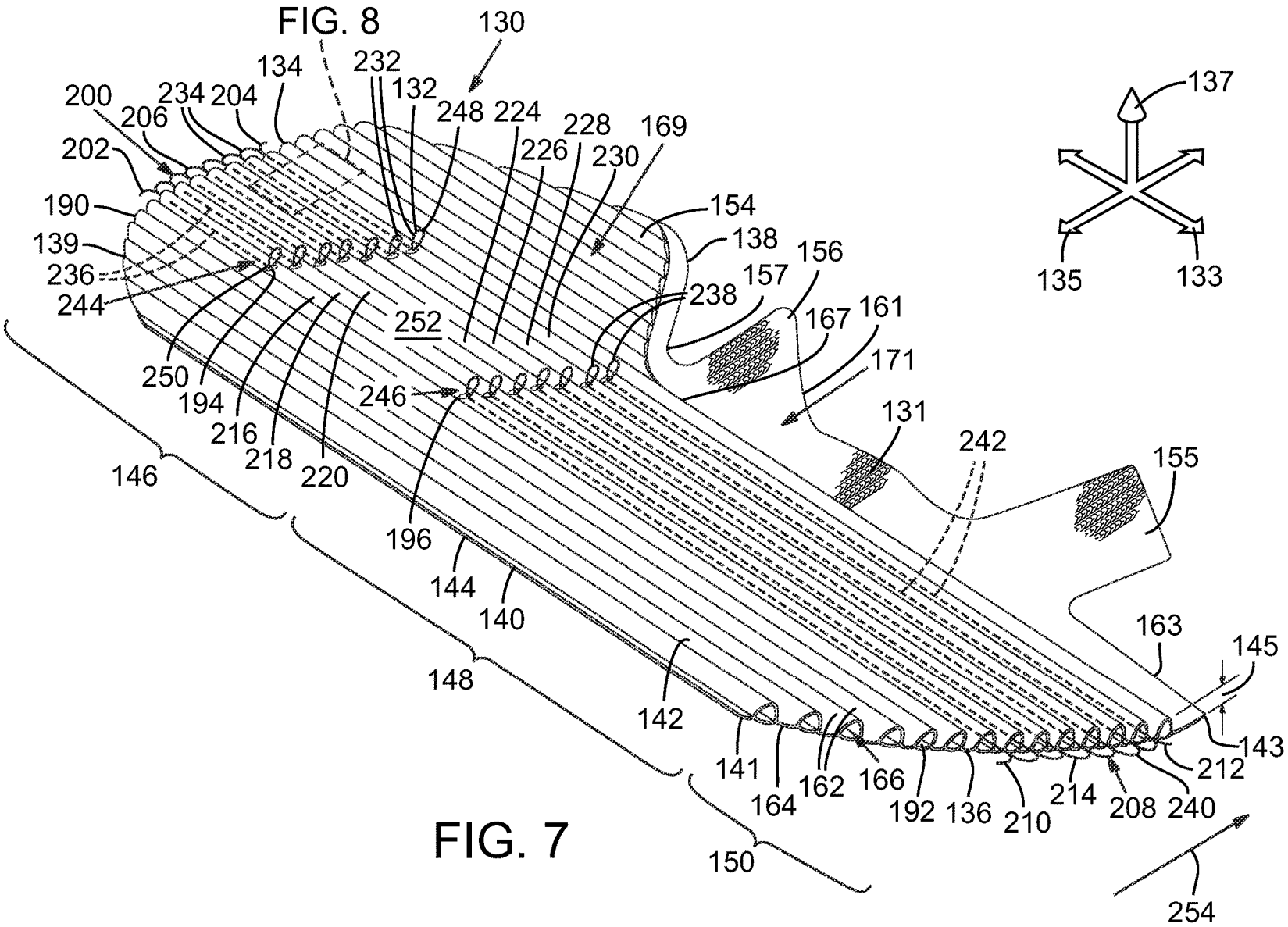
FIG. 7 is a perspective view of a knitted component of the article of footwear of FIG. 1 according to exemplary embodiments.
FIG. 8 is a perspective view of a region of the knitted component of FIG. 7.
Figure 8:
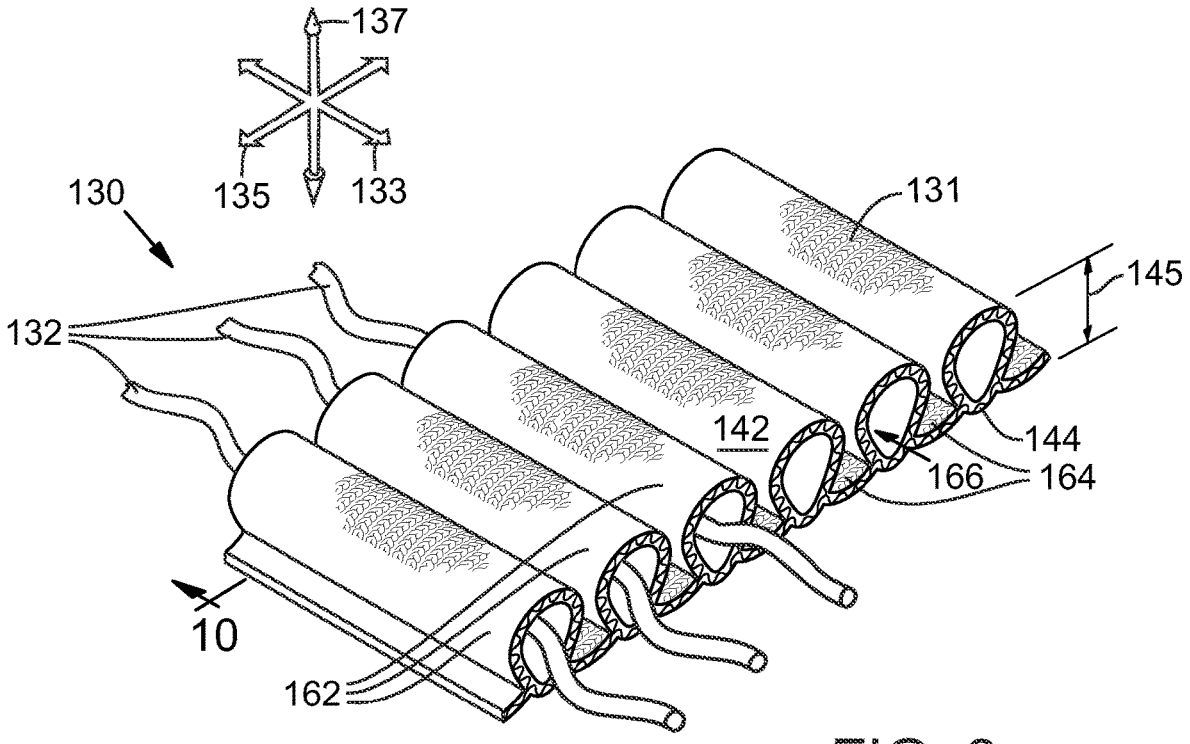

When disassembled as shown in FIG. 7, knit element 131 can be generally sheet-like and can extend along various directions. For example, a first direction 133, a second direction 135, and a third direction 137 are indicated in FIG. 7 for reference purposes.

Generally, knit element 131 can include a first end 134 and a second end 136. First end 134 and second end 136 are spaced apart from each other generally in the first direction 133. Knit element 131 can also include a top edge 138 and a bottom edge 140. Top edge 138 and bottom edge 140 can each extend between first end 134 and second end 136, and top edge 138 and bottom edge 140 can be spaced apart from each other generally in the second direction 135.

Moreover, knit element 131 can include a front surface 142 and a back surface 144. Front surface 142 and back surface 144 can be opposite each other along third direction 137. Also, a thickness 145 of knit element 131 can be measured between front surface 142 and back surface 144, generally in the third direction 137.

Knit element 131 can also be subdivided into various portions. For example, knit element 131 can include a first portion 146, a second portion 148, and a third portion 150, which are arranged generally along the first direction 133. Each of these portions can define respective areas of upper 120 as will be discussed.

In some embodiments illustrated in FIG. 7, relatively large portions of first end 134 and bottom edge 140 can extend in a substantially linear direction. Specifically, first end 134 can extend substantially along the second direction 135 and bottom edge 140 can extend substantially along the first direction 133 in some embodiments. Moreover, in some embodiments, a transition 139 between first end 134 and bottom edge 140 can have convex curvature in some embodiments.

Also, second end 136 can exhibit a relatively high degree of curvature in some embodiments. For example, second end 136 can be convexly curved in some embodiments. More specifically, second end 136 can extend between a first transition 141 and a second transition 143. First transition 141 can be disposed closer to first end 134 (relative to first direction 133) than second transition 143. Also, second end 136 can curve convexly from first transition 141 to second transition 143.

Additionally, top edge 138 can be uneven and/or curved in some embodiments. For example, regions of knit element 131 proximate top edge 138 can include one or more projections. Additionally, regions of knit element 131 proximate top edge 138 can include one or more notches, recesses, or other openings. Specifically, as shown in FIG. 7, knit element 131 can include a first projection 154, which is disposed proximate the first end 134. In some embodiments, first projection 154 can be generally triangular in shape. Top edge 138 can also include a second projection 155, which is disposed proximate the second end 136. In some embodiments, second projection 155 can be generally rectangular in shape. Moreover, top edge 138 can include a third projection 156 that is disposed between first projection 154 and second projection 155. Third projection 156 can be generally triangular in shape in some embodiments. Additionally, top edge 138 can define a notch 157 that is disposed between first projection 154 and third projection 156. Furthermore, top edge 138 can include a concavely curved portion 161 that extends between second projection 155 and third projection 156. Also, top edge 138 can include a substantially linear portion 163, which extends generally along first direction 133 between second projection 155 and second end 136.

In some embodiments, front surface 142 and/or back surface 144 of knit element 131 can be substantially flat. In other embodiments, front surface 142 and/or back surface 144 can include waves, bumps, ribs, raised areas, or recessed areas.

Figure 9:
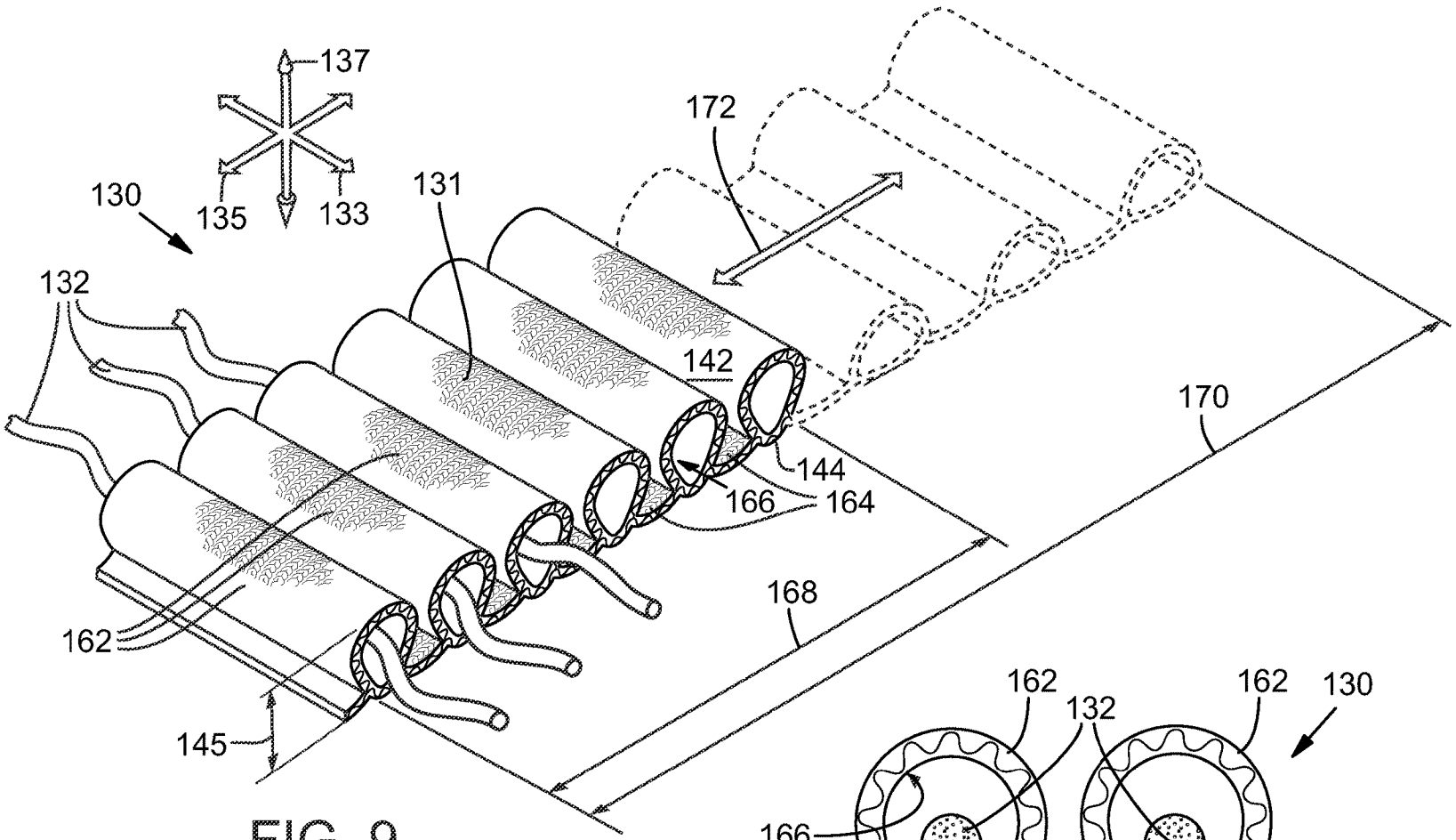
FIG. 9 is a perspective view of the region of the knitted component of FIG. 8, wherein an unstretched, neutral position of the region is illustrated with solid lines, and wherein a stretched position of the region is illustrated with broken lines.
Figure 10:
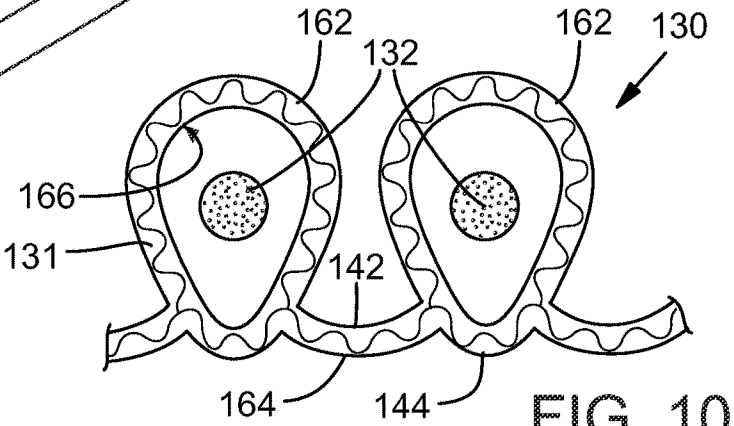
FIG. 10 is a section view of the region of the knitted component taken along the line 10-10 in FIG. 8.

For example, as shown in FIGS. 7-10, knit element 131 can include a plurality of tubular rib structures 162 and a plurality of webs 164. Webs 164 can be disposed between respective pairs of tubular rib structures 162 in some embodiments. For example, as shown in FIGS. 8-10, each web 164 can attach a respective pair of tubular rib structures 162 together. The thickness 145 of knit element 131 at tubular rib structure 162 can be greater than thickness 145 of knit element 131 at web 164. In some embodiments, the majority of knit element 131 can include tubular rib structures 162 that are separated by respective webs 164. In some embodiments, tubular rib structures 162 and webs 164 may be disposed through knit element 131 in an alternating manner. That is, a web 164 may be disposed between adjacent pairs of tubular rib structures 162. Thus, knit element 131 can be wavy, rippled, or otherwise uneven on front surface 142 and/or back surface 144. For example, as shown in FIG. 8-10, webs 164 can be attached to tubular rib structures 162 closer to back surface 144 than front surface 142. As such, back surface 144 can be smoother than front surface 142.

Additionally, in some embodiments, one or more tubular rib structures 162 can be hollow so as to define a passage 166. In some embodiments, the passage 166 can extend along the majority of the length of the respective tubular rib structure 162.

Passages 166 can have any suitable cross sectional shape. For example, as shown in FIGS. 8-10, passages 166 can have an oblong or eccentric cross sectional shape in some embodiments. In additional embodiments, passage 166 can have a substantially circular, ovate, or other rounded shape.

Tubular rib structures 162 can be routed in any suitable direction across knit element 131. Moreover, tubular rib structures 162 can be included in any suitable location on knit element 131. For example, in some embodiments represented in FIG. 7, tubular rib structures 162 can extend longitudinally generally in the first direction 133. Also, in some embodiments, one or more tubular rib structures 162 can extend continuously between first end 134 and second end 136 of knit element. As such, tubular rib structures 162 can extend continuously across first portion 146, second portion 148, and third portion 150 as shown in the embodiment of FIG. 7. Other tubular rib structures 162 can extend across first projection 154.

Also, tubular rib structures 162 can include one or more openings. For example, as shown in FIG. 7, tubular rib structures 162 can include a first open end 190 and a second open end 192. First open end 190 and second open end 192 can be disposed on opposite ends of the respective tubular rib structure 162. For example, in some embodiments, first open end 190 can be disposed proximate first end 134 of knit element 131, and second open end 192 can be disposed proximate second end 136 of knit element 131. Additionally, tubular rib structures 162 can include one or more openings that are disposed between the first and second open ends 190, 192. For example, as shown in FIG. 7, tubular rib structures 162 can include a first intermediate opening 194 and a second intermediate opening 196. First and/or second intermediate opening 194, 196 can be through holes that extend through the front surface 142 of knit element 131 in some embodiments. Also, first and second intermediate openings 194, 196 can be disposed generally within first portion 146. First and second intermediate openings 194, 196 can be spaced apart from each other in the first direction 133. Moreover, first intermediate openings 194 can be disposed closer to the first end 134 than the second intermediate openings 196.

Additionally, in some embodiments, knit element 131 can include one area that includes tubular rib structures 162 and another area that does not. For example, as shown in FIG. 7, a boundary 167 can be defined between a wavy area 169 and a substantially smooth area 171. The wavy area 169 can include the tubular rib structures 162 and connecting webs 164. The smooth area 171 can be substantially flat and sheet-like. Additionally, the boundary 167 can extend between the second end 136 and the top edge 138, proximate the first projection 154 in some embodiments. Significant portions of the boundary 167 can extend substantially parallel to the first direction 133 in some embodiments. Also, the wavy area 169 can be defined between the boundary 167, the first end 134, the bottom edge 140, and the second end 136, whereas the smooth area 171 can be defined between the boundary 167, the top edge 138, and the second end 136 in some embodiments.

One or more areas of knit element 131 can be flexible, resilient, elastic, and stretchable in some embodiments. For example, as shown in FIG. 9, a representative area of knit element 131 is shown in an unstretched position in solid lines and in a stretched position in broken lines. The unstretched position can also be referred to as a "first position" or "neutral position" in some embodiments. The stretched position can also be referred to as a "second position." In the first position, the representative area of knit element 131 can have a first length 168. In the second position, the representative area of knit element 131 can have a second length 170, which is greater than first length 168. In some embodiments, a stretching force represented by arrows 172 can be applied, for example, in the second direction 135 for stretching knit element 131 between the first length 168 and second length 170. In some embodiments, when the stretching force is reduced, the resiliency of knit element 131 can cause knit element 131 to return to the first position.

In some embodiments, the stretchability and resiliency of knit element 131 can be at least partly due to the knitted structure of knit element 131. In additional embodiments, the stretchability and resiliency can be at least partly due to the elasticity and stretchability of the yarn(s) used to form knit element 131. For example, one or more yarns of knit element 131 can be made from elastane or other resilient, stretchable material. Thus, in some embodiments, at least some yarns of knit element 131 can be resiliently stretched in length from a first length to second length, wherein the second length is at least 20% greater than the first length. When the stretching force is removed, the yarn of knit element 131 can recover back to its unstretched, neutral length.

Additionally, in some embodiments, some portions of knit element 131 can be more elastic than other portions. For example, webs 164 of knit element 131 can be more elastic than tubular rib structures 162 in some embodiments. Furthermore, in some embodiments, smooth area 171 of knit element 131 can be more elastic than the wavy area 169 of knit element 131.

It will be appreciated that upper 120 can include other structures that are similar in some respects to knit element 131, but these structures can differ in other respects. For example, upper 120 can include a non-knitted structure that defines a tunnel, tube, or other hollow passageway, similar to passages 166. Moreover, upper 120 can include a structure assembled from multiple parts (i.e., a non-unitary structure) that defines a tunnel, tube, or other hollow passageway. Additionally, in some embodiments, upper 120 can be at least partially defined by so-called "spacer knit" fabric having two overlapping layers that are attached by transverse yarns that extend between the layers. In these embodiments, passages can be defined between the two overlapping knit layers and between separated transverse yarns.

Embodiments of Tensile Elements

Referring now to FIGS. 7-10, embodiments of the tensile elements 132 will be discussed. In some embodiments, knitted component 130 can include a plurality of tensile elements 132. It will be appreciated that tensile elements 132 can be disposed on knitted component 130 in any suitable area. When knitted component 130 is assembled into upper 120, for example, one or more tensile elements 132 can extend generally between lateral side 115 and medial side 117. As such, tensile elements 132 can extend about the wearer's foot and, in some embodiments, tensile elements 132 can compress against the wearer's foot.

Tensile element 132 can be of any suitable type of strand, yam, cable, cord, filament (e.g., a monofilament), thread, rope, webbing, or chain, for example. In comparison with the yarns of knit element 131, the thickness of tensile element 132 may be greater. Although the cross-sectional shape of tensile element 132 may be round, triangular, square, rectangular, elliptical, or irregular shapes may also be utilized. Moreover, the materials forming tensile element 132 may include any of the materials for the yarn of knit element 131, such as cotton, elastane, polyester, rayon, wool, and nylon. As noted above, tensile element 132 may exhibit greater stretch-resistance than knit element 131. As such, suitable materials for tensile element 132 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as tensile element 132.

Tensile element 132 and other portions of knitted component 130 can additionally incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010; U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012; U.S. patent application Ser. No. 13/781,336 to Podhajny, entitled "Method of Knitting A Knitted Component with a Vertically Inlaid Tensile Element", filed on Feb. 28, 2013 and published as U.S. Patent Publication No. 2014/0237861 on Aug. 28, 2014, each of which is hereby incorporated by reference in its entirety.

Tensile elements 132 can be attached and incorporated with knit element 131 in any suitable manner. For example, tensile elements 132 can be received or enclosed within element 131 to attach tensile elements 132 to element 131. More specifically, in some embodiments, tensile elements 132 can extend through a tube, channel, tunnel, or other passage defined by element 131. Tensile elements 132 can also be disposed between separate layers of element 131 or otherwise enclosed by element 131.

In some embodiments, tensile elements 132 can be inlaid within a course or wale of knit element 131. In additional embodiments, such as the embodiments of FIGS. 7-10, tensile element 132 can extend through and along passage 166. Stated differently, at least one or more passages 166 within tubular rib structures 162 of knit element 131 can receive a tensile element 132. In additional embodiments, such as embodiments in which knit element 131 is formed from spacer-knit fabric, tensile elements 132 can extend through passages that are defined between different layers of knit element 131.

Furthermore, as mentioned above, upper 120 can be defined substantially from a non-knit structure and/or from a non-unitary structure assembled from pieces that are joined together. It will be appreciated that these structures can define elongate, hollow tubes or passages that receive tensile elements 132 to incorporate tensile elements 132 in footwear 100.

Tensile element 132 can extend through any number of the tubular rib structures 162. For example, as shown in the embodiment of FIG. 7, only some of the tubular rib structures 162 receive tensile element 132. In other embodiments, each of the tubular rib structures 162 receives tensile element 132. Furthermore, in some embodiments, tensile elements 132 can be disposed in tubular rib structures 162 that neighbor one another on knit element 131. In other embodiments, tensile element 132 can be present in one tubular rib structure 162, and tensile element 132 can be absent from a neighboring tubular rib structure 162. For example, tensile element 132 can extend through every other tubular rib structure 162, to form a staggered, or alternating, arrangement. In other embodiments, the presence of tensile elements 132 may not be as regular. For example, there may be two or more neighboring tubular rib structures 162 that contain tensile elements 132, and these tubular rib structures 162 can be adjacent to one or more tubular rib structures 162 that do not contain tensile elements 132.

In some embodiments, a single, continuous section of tensile element 132 can extend through multiple passages 166. In other embodiments, different, individual tensile elements 132 extend through different tubular rib structures 162.

Moreover, in some embodiments, tensile elements 132 can extend along a portion of the passage 166. In other embodiments, tensile elements 132 can extend along substantially the entire passage 166.

Additionally, in some embodiments, tensile element 132 can extend primarily along the first direction 133 relative to knit element 131. Furthermore, in some embodiments, tensile element 132 can extend in second direction 135 and/or third direction 137.

Furthermore, in some embodiments, portions of tensile stands 132 can extend out of the respective passages 166 and can be exposed from knit element 131. Still further, in some embodiments, tensile element 132 can extend out from knit element 131 and can re-enter knit element 131. As such, a loop or other similar feature can be defined by tensile element 132, between the exit and re-entry point of tensile element 132. In some embodiments, tensile element 132 can extend out from one passage 166 and re-enter a different passage 166 so as to define a loop or similar structure.

Tensile elements 132 can be routed across knit element 131 in predetermined areas. Tension within tensile element 132 can be transferred, via the tensile element 132, from one area of knit element 131 to another. As such, the tensile element 132 can distribute forces across knit element 131 in a predetermined and advantageous manner. Moreover, because of the routing of the tensile element 132, the tensile element 132 can limit stretching and/or flexure of the knit element 131 in a predetermined manner. Moreover, tensile elements 132 can be routed to define loops or other structures that serve to attach shoelace 129 or other securement device 127 to knit element 131.

As shown in FIG. 7, knitted component 130 can include a first tensile element 200. First tensile element 200 can include a first end 202, a second end 204, and an intermediate portion 206 that extends continuously between first and second ends 202, 204. Also, knitted component 130 can include a second tensile element 208. Second tensile element 208 can include a first end 210, a second end 212, and an intermediate portion 214 that extends continuously between first and second ends 210, 212. As will be discussed, first tensile element 200 and second tensile element 208 can be sub-divided into a plurality of segments.

In some embodiments, first tensile element 200 can extend across knit element 131 primarily within first portion 146. First end 202 and second end 204 of first tensile element 200 can extend out from and can be exposed from first end 134 of knit element 131. Intermediate portion 206 of first tensile element 200 can continuously extend through portions of a first tubular rib structure 216, a second tubular rib structure 218, a third tubular rib structure 220, a fourth tubular rib structure 224, a fifth tubular rib structure 226, a sixth tubular rib structure 228, and a seventh tubular rib structure 230. More specifically, first tensile element 200 can extend into first open end 190 of first tubular rib structure 216, along the first direction 133, toward first intermediate opening 194 of first tubular rib structure 216. First tensile element 200 can also exit first intermediate opening 194 of first tubular rib structure 216, turn back toward first intermediate opening 194, and re-enter first intermediate opening 194. First tensile element 200 can further extend back along first tubular rib structure 216, along the first direction 133, and exit the first open end 190 of first tubular rib structure 216. Additionally, first tensile element 200 can extend generally in the second direction 135 toward the top edge 138 and re-enter knit element 131 via second tubular rib structure 218. This routing pattern can be repeated as first tensile element 200 extends through second tubular rib structure 218, third tubular rib structure 220, fourth tubular rib structure 224, fifth tubular rib structure 226, sixth tubular rib structure 228, and seventh tubular rib structure 230. In some embodiments, first tensile element 200 can terminate at second end 204, which can extend out from first open end 190 of seventh tubular rib structure 230.

Routed as such, first tensile element 200 can define a plurality of first inner loop segments 232, where strand 200 exits and re-enters intermediate openings 194. Also, first tensile element 200 can define a plurality of first outer loop segments 234, where strand 200 exits open end 190 of one tubular rib structure 162 and re-enters open end 190 of another tubular rib structure 162. Furthermore, strand 200 can define a plurality of first intermediate segments 236, where strand 200 extends between respective inner and outer segments 232, 234.

Figure 25:
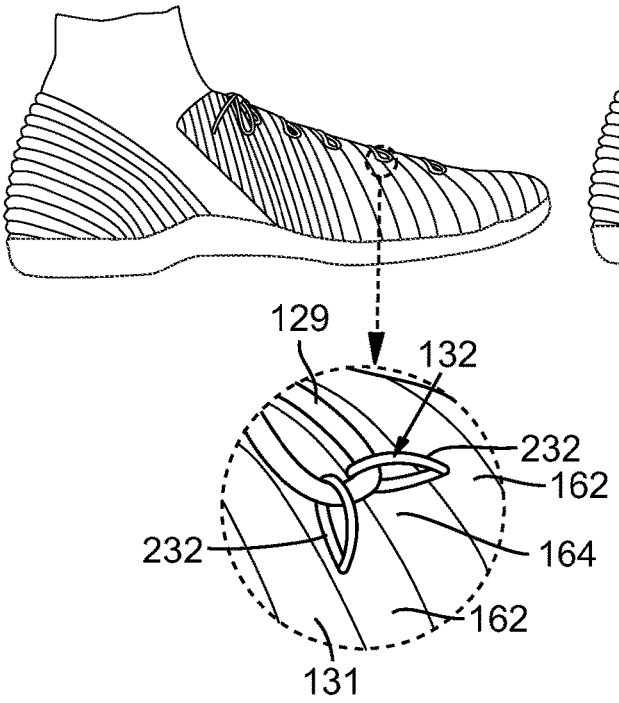
FIG. 25 is a detail view of a lace loop of the article of footwear according to exemplary embodiments.
Figure 26:
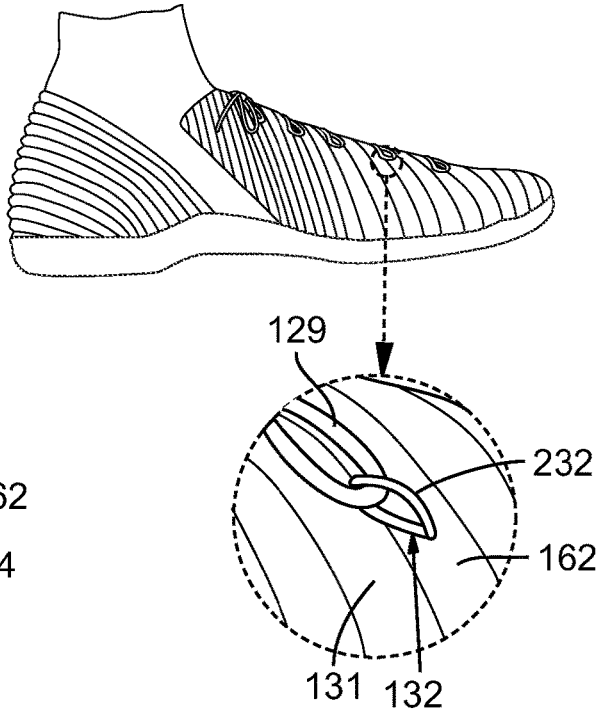
FIG. 26 is a detail view of a lace loop of the article of footwear according to additional exemplary embodiments.

As will be discussed and as shown in FIG. 1, for example, first inner loop segments 232 can be configured for receiving shoelace 129 or other securement device 127. Thus, first inner loop segments 232 can be referred to as "first lace loops." First inner loop segments 232 are shown receiving shoelace 129 in detail in FIG. 25 and will be discussed in detail below. Alternative embodiments are shown in FIG. 26 and will be discussed in detail below.

In some embodiments, second tensile element 208 can have features corresponding to first tensile element 200, except that second tensile element 208 can extend across knit element 131 primarily within second and third portions 148, 150. First end 210 and second end 212 of second tensile element 208 can extend out from and can be exposed from second end 136 of knit element 131. Intermediate portion 214 of second tensile element 208 can continuously extend through portions of tubular rib structures 216, 218, 220, 224, 226, 228, 230. More specifically, second tensile element 208 can extend into second open end 192 of first tubular rib structure 216, along the first direction 133, toward second intermediate opening 196 of first tubular rib structure 216. Second tensile element 208 can also exit second intermediate opening 196 of first tubular rib structure 216, turn back toward second intermediate opening 196, and re-enter second intermediate opening 196. Second tensile element 208 can further extend back along first tubular rib structure 216, along the first direction 133, and exit the second open end 192 of first tubular rib structure 216. Additionally, second tensile element 208 can extend generally in the second direction 135 toward the top edge 138 and re-enter knit element 131 via second tubular rib structure 218. This routing pattern can be repeated as second tensile element 208 extends through second tubular rib structure 218, third tubular rib structure 220, fourth tubular rib structure 224, fifth tubular rib structure 226, sixth tubular rib structure 228, and seventh tubular rib structure 230. In some embodiments, second tensile element 208 can terminate at second end 212, which can extend out from second open end 192 of seventh tubular rib structure 230.

Routed as such, second tensile element 208 can define a plurality of second inner loop segments 238, where strand 208 exits and re-enters intermediate openings 196. Also, second tensile element 208 can define a plurality of second outer loop segments 240, where strand 208 exits open end 192 of one tubular rib structure 162 and re-enters open end 192 of another tubular rib structure 162. Furthermore, strand 208 can define a plurality of second intermediate segments 242, where strand 208 extends between respective inner and outer segments 238, 240.

As will be discussed and as shown in FIG. 1, for example, second inner loop segments 238 can be configured for receiving shoelace 129 or other securement device 127. Thus, second inner loop segments 238 can be referred to as "second lace loops."

In some embodiments, the first inner loop segments 232 can be arranged in a first row 244, and/or the second inner loop segments 238 can be arranged in a second row 246. First row 244 and second row 246 can be substantially parallel and spaced apart generally in the first direction 133 in some embodiments. Also, first row 244 and second row 246 can extend substantially between the top edge 138 and the bottom edge 140. Moreover, first row 244 and second row 246 can be disposed at an angle relative to the second direction 135. As such, a bottom end 250 of first row 244 can be disposed closer to first end 134 than a top end 248 of first row 244. Second row 246 can be disposed at a corresponding angle.

Also, the knit element 131 can include a throat area 252, which is disposed between first row 244 and second row 246. In some embodiments, tensile elements 132 can be absent from throat area 252. As such, throat area 252 of knitted component 130 can exhibit increased elasticity as compared to areas where tensile elements 132 are present.

Also, as will be discussed, throat area 252 can at least partially define and correspond to throat 128 of article of footwear 100.

Embodiments of Assembly of Knitted Component and Upper

Knitted component 130, such as the embodiment illustrated in FIG. 7, can be manufactured using any suitable technique. For example, as mentioned above, knitted component 130 can be knitted using a flat knitting procedure, such as weft knitting and warp knitting processes. In some embodiments, knitted component 130 can be formed using a flat knitting machine. Also, in some embodiments, bottom edge 140 can be formed initially and top edge 138 can be formed last such that a knitting direction is defined as indicated by arrow 254 in FIG. 7. Additionally, in some embodiments, tensile elements 132 can be provided within tubular rib structures 162 automatically as knit element 131 is knitted and formed. In other embodiments, element 131 can be formed, and tensile elements 132 can be subsequently incorporated in element 131. Also, tensile elements 132 can be incorporated in element 131 either automatically or manually.

Additional details relating to the knitting process for forming knitted component 130 can be found in U.S. Provisional Patent Application No. 62/057,264, filed on Sep. 30, 2014, which was filed as U.S. Nonprovisional patent application Ser. No. 14/535,413 on Nov. 7, 2014, and entitled "Article of Footwear Incorporating A Knitted Component with Inlaid Tensile Elements and Method of Assembly", the disclosure of which applications are hereby incorporated by reference in its entirety.

Once knitted component 130 has been formed, additional objects can be attached, such as logos, tags, and the like. Moreover, knitted component 130 can be heated, for example, using steam. Subsequently, knitted component 130 can be assembled to define upper 120 of article of footwear 100.

Figure 11:
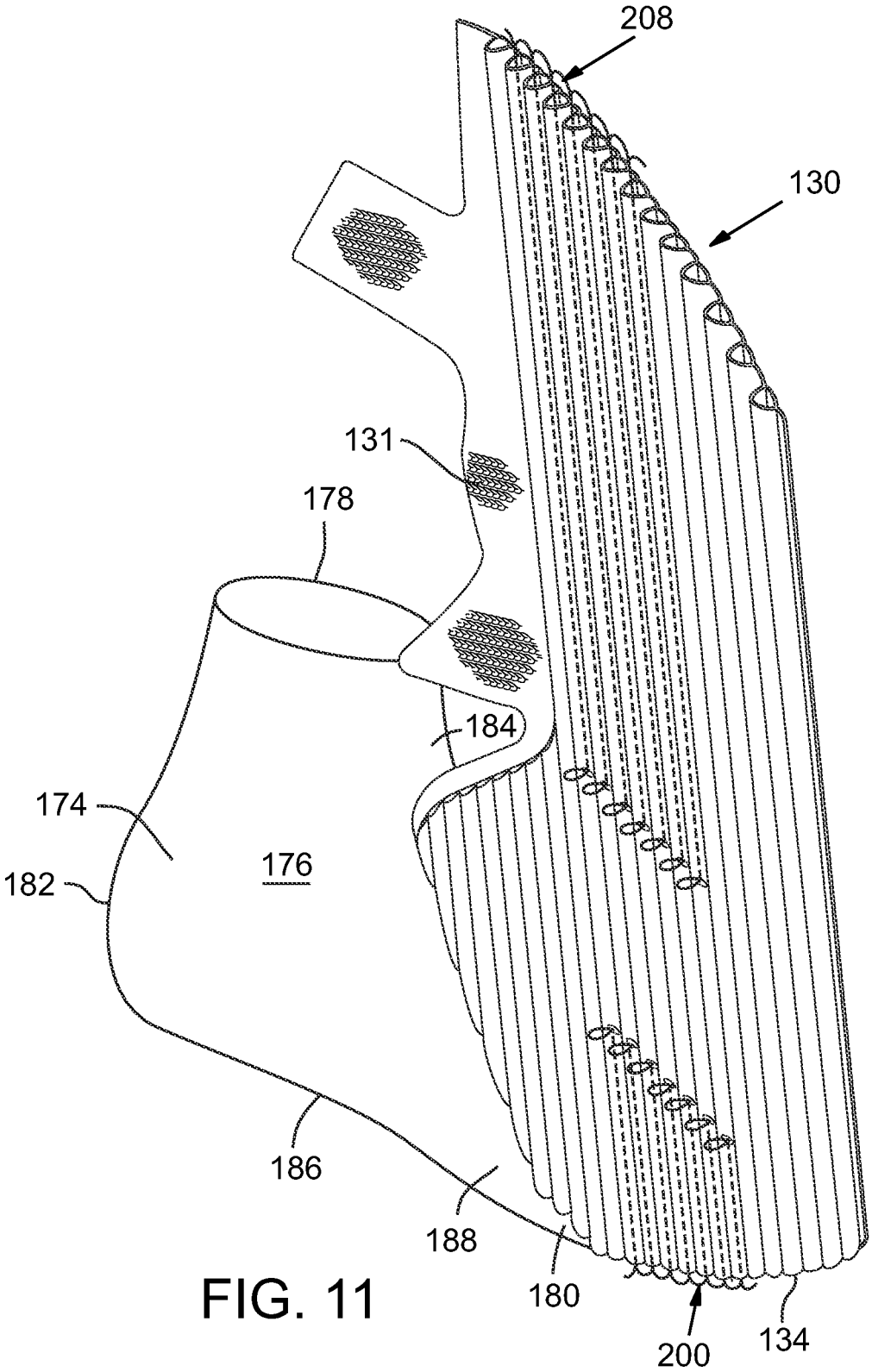
FIG. 11 is a perspective view of the knitted component shown in the process of being assembled into an upper for the article of footwear of FIG. 1.
Figure 12:
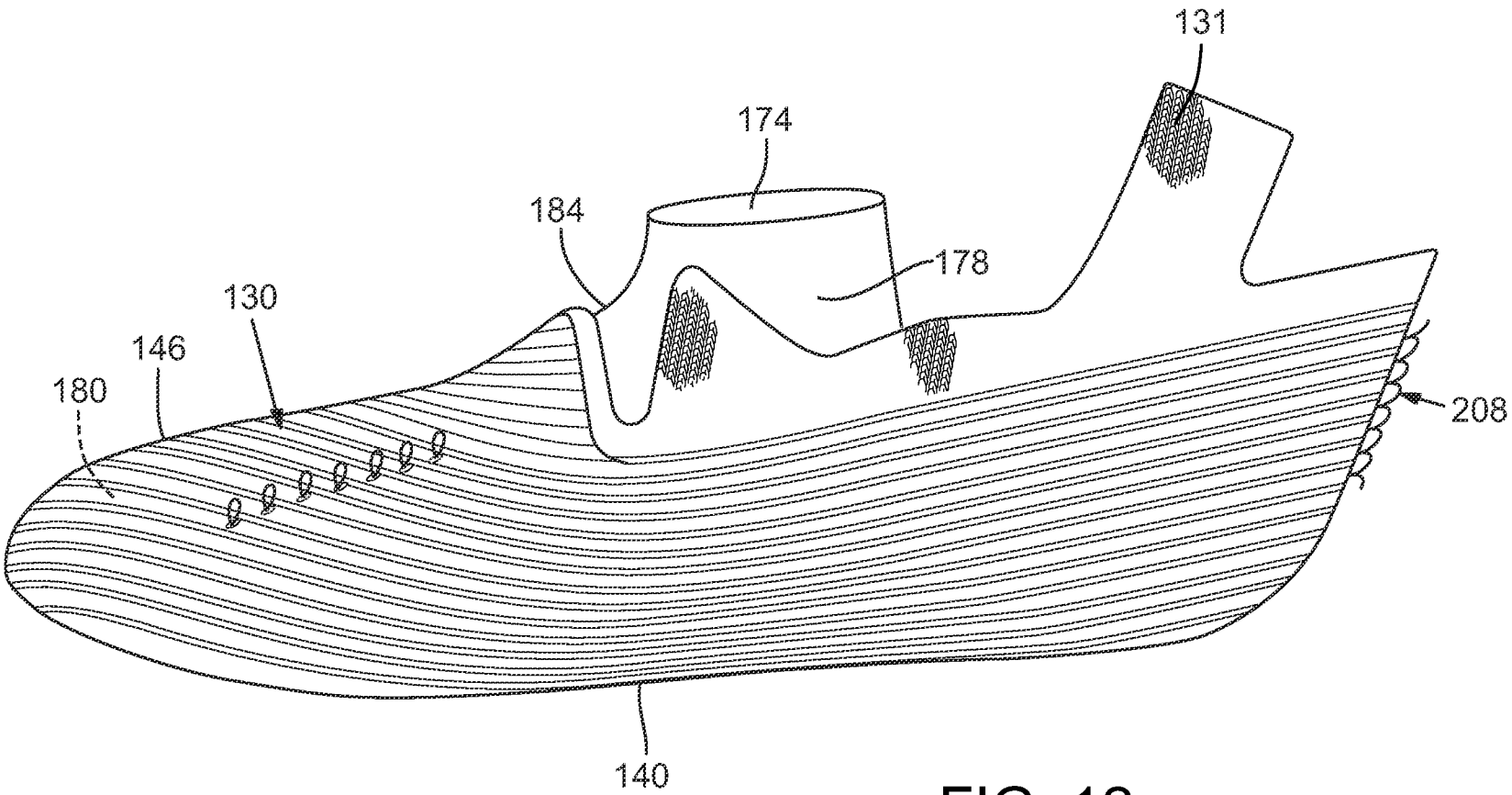
FIG. 12 is a perspective view of the knitted component of FIG. 11 shown in the process of being further assembled.

FIGS. 11-14 illustrate an embodiment of a way knitted component 130 can be assembled from the generally flat configuration of FIG. 7 to the three-dimensional configuration of upper 120. As shown in FIGS. 11-12, knitted component 130 can wrap around the foot to define the three-dimensional shape. Knitted component 130 can wrap around the foot from either the medial or lateral side, across the opposite side of the foot, and back to the opposite side. For example, in some embodiments, knitted component 130 can wrap from the lateral side of the foot, across the forefoot and top of the foot, across medial side of the foot, across the heel, and back to lateral side of the foot. However, it will be appreciated that knitted component 130 could be configured to wrap around the foot differently. For example, knitted component 130 can wrap from the medial side of the foot, across the forefoot and top of the foot, across the lateral side and heel, and back to the medial side of the foot. Other configurations can also fall within the scope of the present disclosure.

Figure 13:
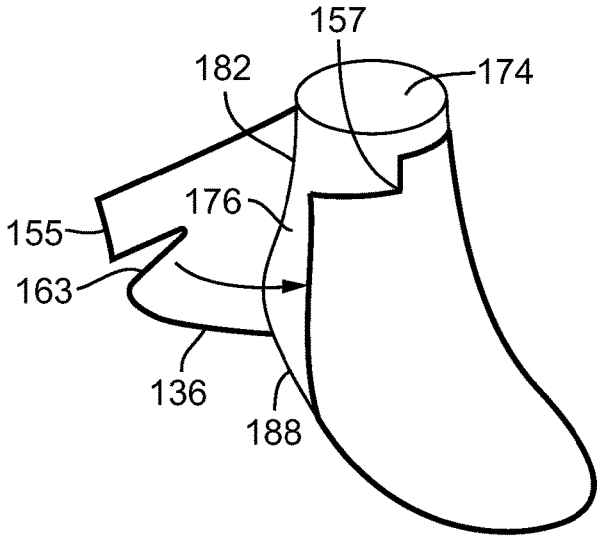
FIG. 13 is a perspective view of the knitted component of FIG. 12 shown in the process of being further assembled.

In FIGS. 11-13, the knitted component 130 is shown in the process of being wrapped around a last 174. Last 174 can resemble an anatomical foot. Thus, last 174 can include a lateral side 176, a medial side 178, a forefoot 180, and a heel 182, each of which can generally resemble the contoured surfaces of an anatomical foot. Last 174 can further include a top 184 and a bottom 186. Moreover, last 174 can include a bottom periphery 188, which is defined generally at a transition between top 184 and bottom 186 of last 174, and which extends continuously between lateral side 176, forefoot 180, medial side 178, and heel 182.

As shown in FIG. 11, the assembly process can begin, in some embodiments, by positioning first end 134 on lateral side 176 of last 174, adjacent bottom periphery 188, and adjacent forefoot 180 of last 174. First end 134 can be temporarily secured to last 174 at this area, for example, by pins or other fasteners. Also, first projection 146 can be laid over lateral side 176 and top edge 138 of first portion 146 can be secured to last 174 at bottom periphery 188 on lateral side 176.

Then, as shown in FIG. 12, knitted component 130 can be wrapped over the top 184, forefoot 180, and medial side 178 of last 174. Also, bottom edge 140 of knitted component 130 can be secured along medial side 178 of last 174, adjacent bottom periphery 188. As a result, first portion 146 of knit element 131 can cover over top 184 of last 174, proximate forefoot 180.

Figure 14:
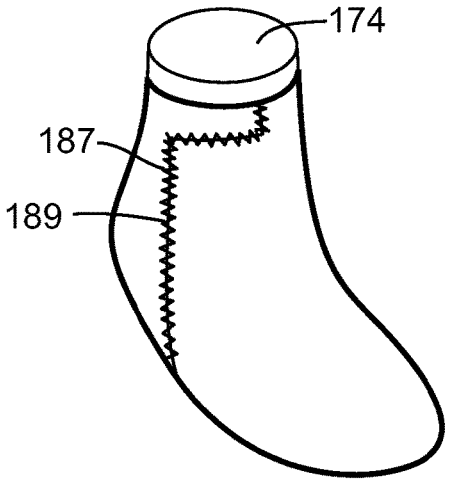
FIG. 14 is a perspective view of the knitted component of FIG. 13 shown in the process of being further assembled.

Next, as shown in FIGS. 13 and 14, second end 136 can be wrapped around heel 182 of last 174 and attached to lateral side 176, proximate heel 182 at bottom periphery 188. Also, second projection 155 can be received and nested within notch 157, and linear portion 163 can abut against the opposing portion of top edge 138 to define seam 189.

As shown in FIG. 14, the adjacent and opposing edges of knitted component 130 can abut against each other to define a seam 189. Seam 189 can be secured using stitching 187. However, it will be appreciated that seam 189 can be secured using adhesives, fasteners, or other securing device without departing from the scope of the present disclosure.

Figure 15:
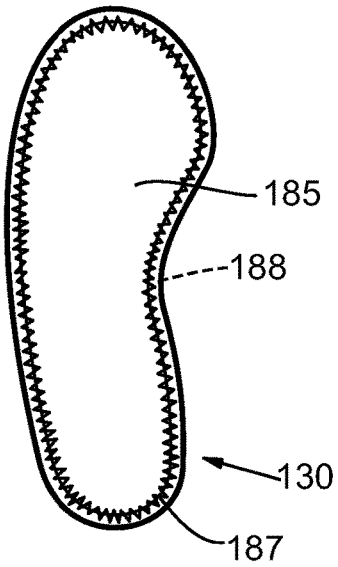
FIG. 15 is a perspective view of the knitted component of FIG. 14 shown in the process of being further assembled.
Figure 16:
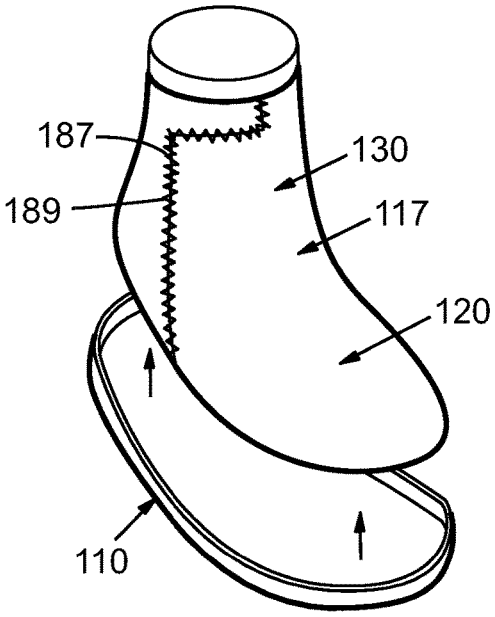
FIG. 16 is a perspective view of the knitted component of FIG. 15 being further assembled.

Next, in some embodiments represented in FIG. 15, a lower panel 185 can be attached to knitted component 130. Lower panel 185 can also be referred to as a so-called "strobel" or "strobel member." Lower panel 185 can be attached to corresponding edges of knitted component 130, proximate bottom periphery 188 of last 174. Lower panel 185 can be attached by stitching 187, adhesives, fasteners, or other attachment device. Subsequently, sole structure 110 can be attached to knitted component 130 as shown in FIG. 16. Sole structure 110 can be attached using adhesives in some embodiments. It will be appreciated that lower panel 185 and sole structure 110 can extend along bottom 186 of last 174 and, thus, underneath the wearer's foot when worn.

In some embodiments, when lower panel 185 and/or sole structure 110 is attached, first outer loop segments 234 and second outer loop segments 240 (see FIG. 7) can be fixed relative to knit element 131. For example, when adhesives are used, first outer loop segments 234 and second outer loop segments 240 can be adhesively fixed to sole structure 110 and lower panel 185.

Figure 5:
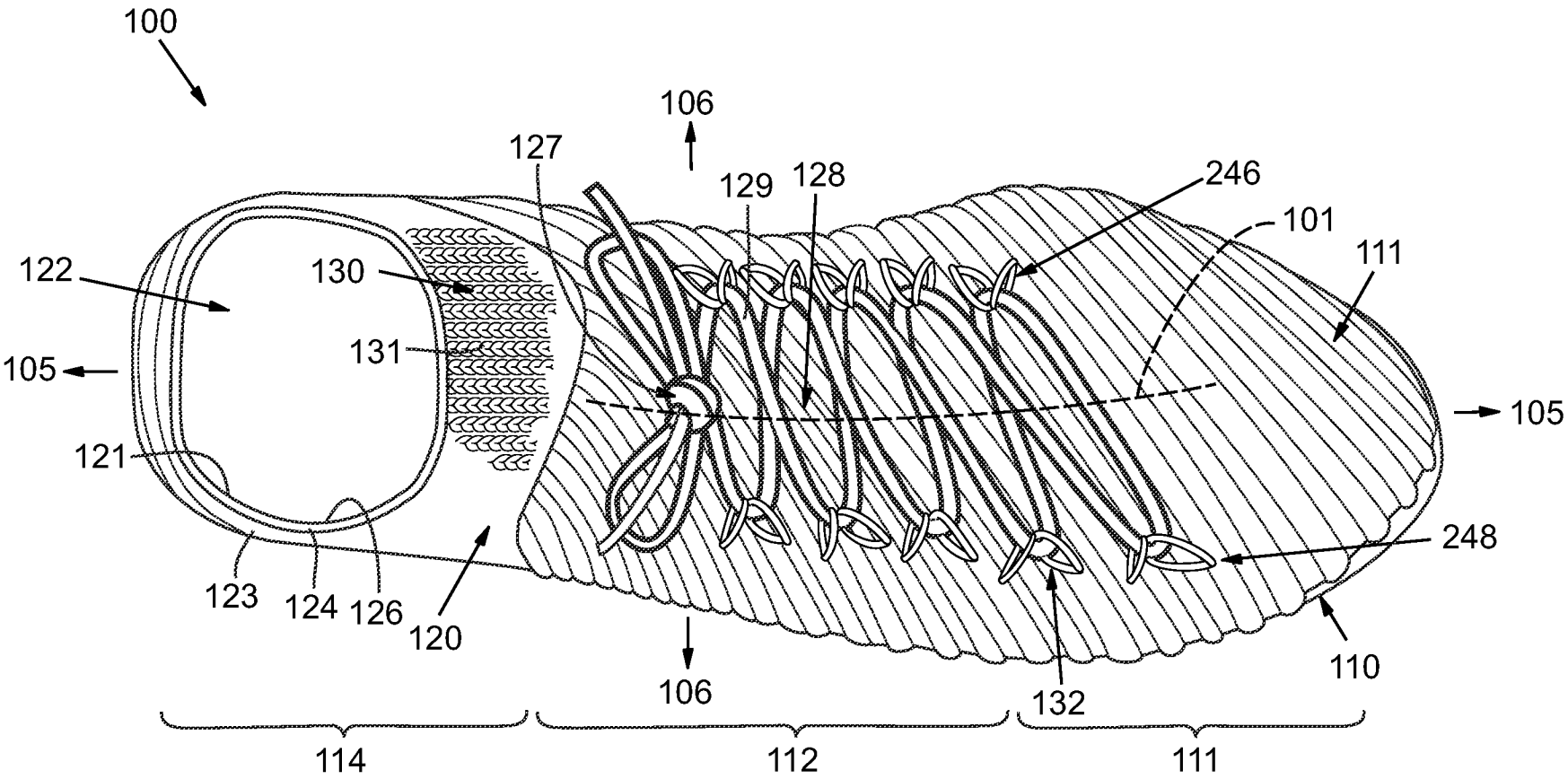
FIG. 5 is a top view of the article of footwear of FIG. 1.
Figure 6:
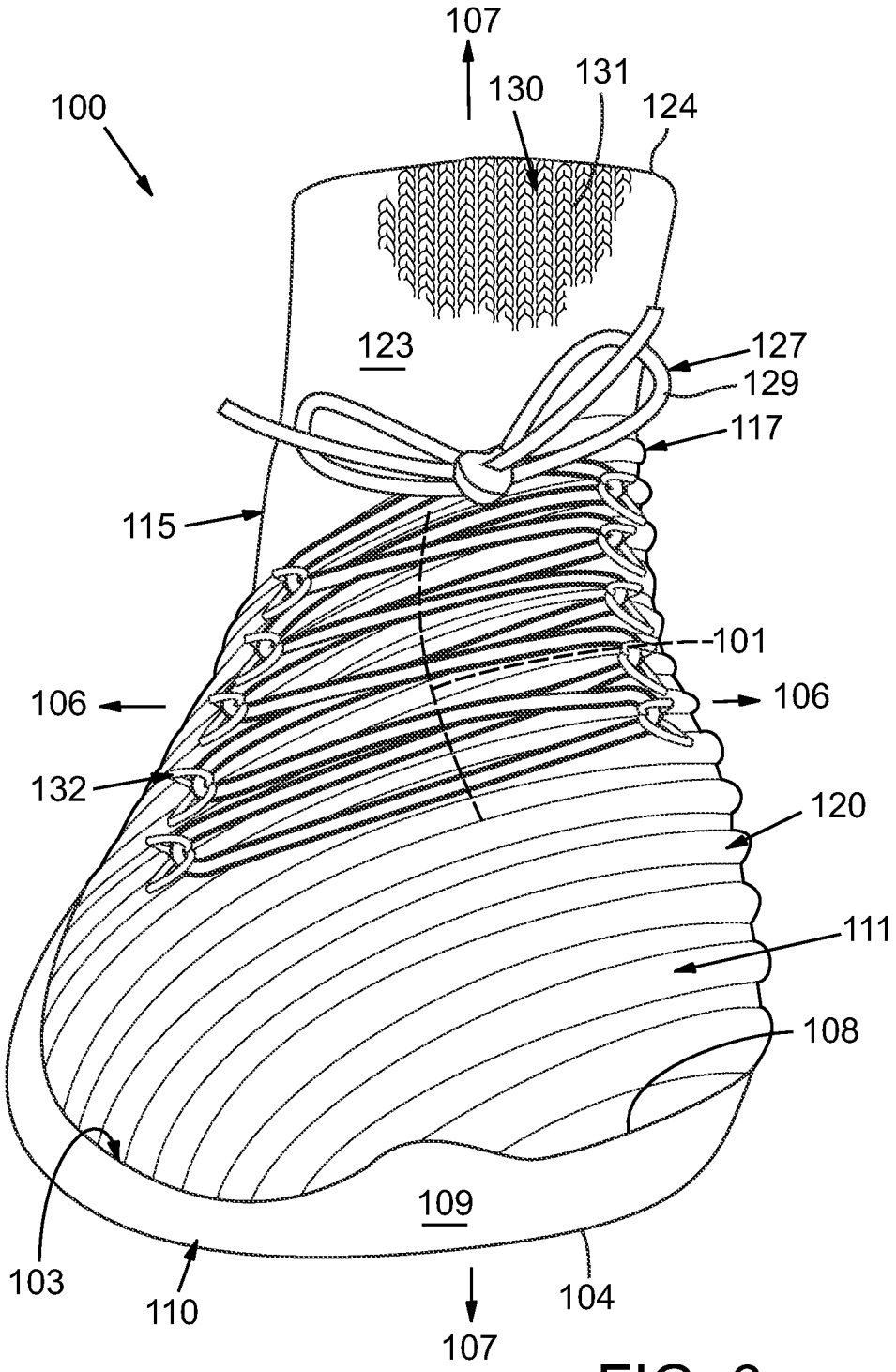
FIG. 6 is a front view of the article of footwear of FIG. 1.

Finally, shoelace 129 can be attached to knitted component 130. For example, as shown in FIGS. 1, 5, and 6, shoelace 129 can extend back-and-forth across throat 128 and can be attached to lateral side 115 and medial side 117. More specifically, shoelace 129 can be received within first and second inner loop segments 232, 238. In some embodiments represented in FIGS. 1, 5, 6, and 25, two or more adjacent first loop segments 232 can receive a single pass of shoelace 129. Similarly, two or more adjacent loop segments 238 can receive a single pass of shoelace 129. In other embodiments represented in FIG. 26, a single first loop segment 232 can receive a single pass of shoelace 129. Individual second loop segments 238 can receive shoelace 129 similarly in some embodiments.

Accordingly, when upper 120 is assembled, tensile elements 132 can be disposed in predetermined areas relative to the wearer's foot. As such, tensile elements 132 can provide stretch resistance in certain areas of upper 120, can transfer forces across upper 120 for improving fit and performance of footwear 100, and/or can provide other advantages.

More specifically, as shown in FIG. 1, when knitted component 130 is assembled to define upper 120, first tensile element 200 can be disposed generally on lateral side 115 of upper 120. First inner loop segments 232 can be disposed proximate throat 128 to attach shoelace 129 to lateral side 115 of upper 120. In some embodiments, first tensile element 200 can also extend continuously between throat 128 and lower portion 125 of upper 120. Stated differently, first tensile element 200 can extend continuously between throat 128 and sole structure 110 on lateral side 115. Furthermore, first tensile element 200 can extend back-and-forth continuously between throat 128 and lower portion 125 as first tensile element 200 extends generally along the throat axis 101. As such, tension in first tensile element 200 can transfer, for example, from throat region to lower portion 125 and/or sole structure 110. Thus, by tightening shoelace 129, tension of first tensile stand 200 can be increased, and lower portion 125 and sole structure 110 can be pulled generally upward toward the wearer's foot. Thus, the lateral side 115 can conform and fit comfortably against the wearer's foot. Moreover, first tensile element 200 can resist deformation of lateral side 115, for example, when the wearer's foot pushes against the lateral side 115. As such, the first tensile element 200 can allow the wearer to move laterally (i.e. cut) in the transverse direction 106 more effectively.

Figure 2:
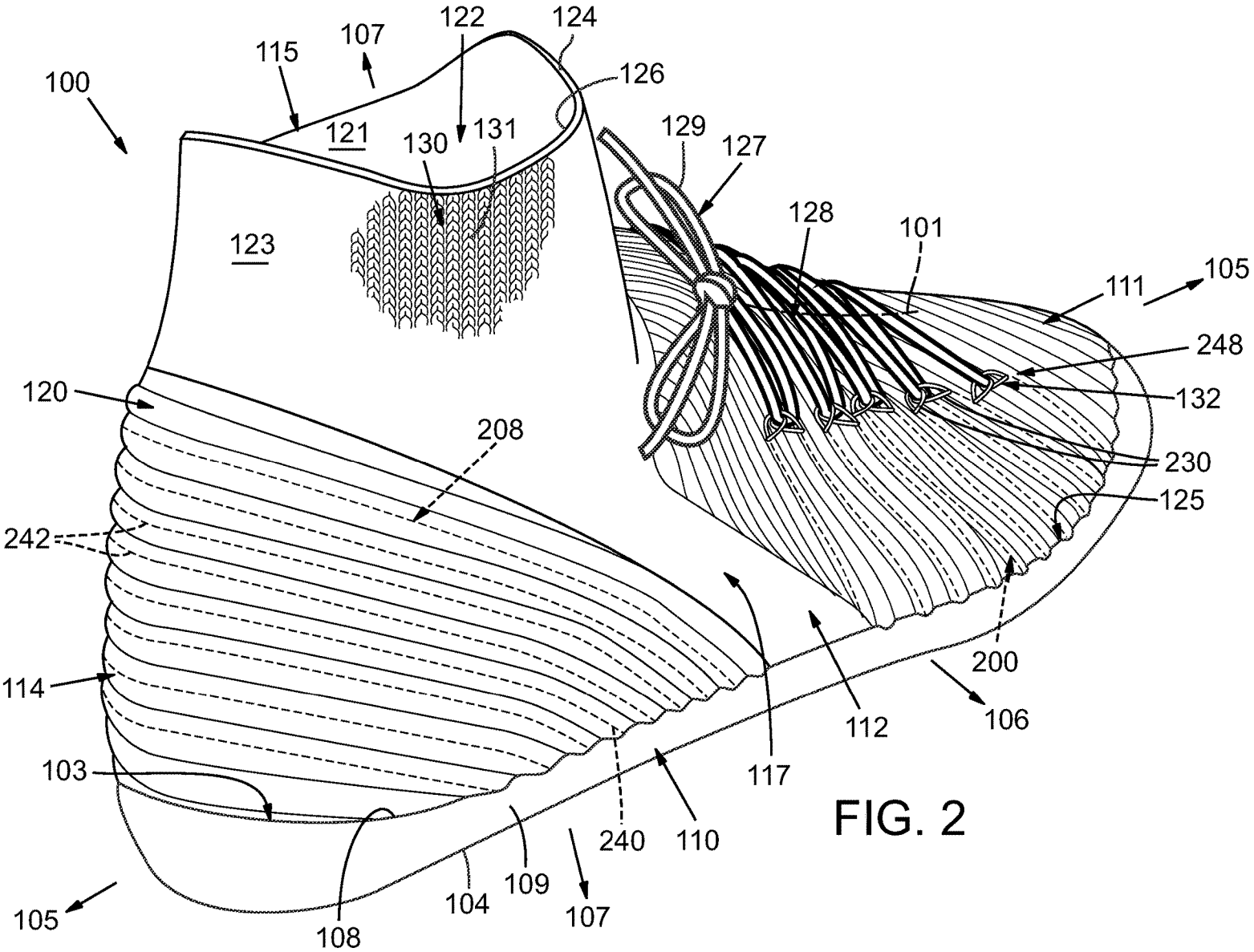
FIG. 2 is a rear perspective view of the article of footwear of FIG. 1.
Figure 3:
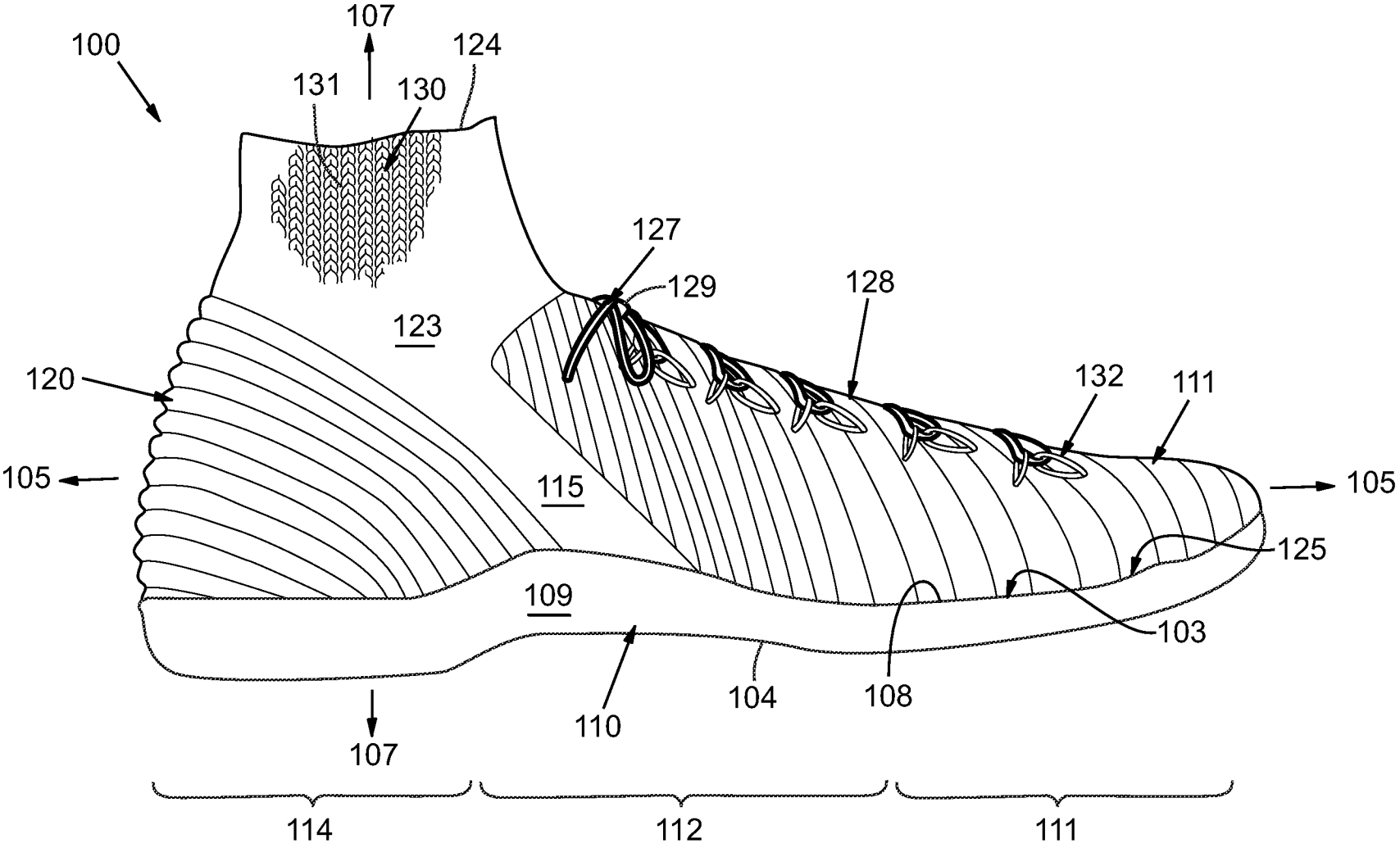
FIG. 3 is a lateral side view of the article of footwear of FIG. 1.
Figure 4:
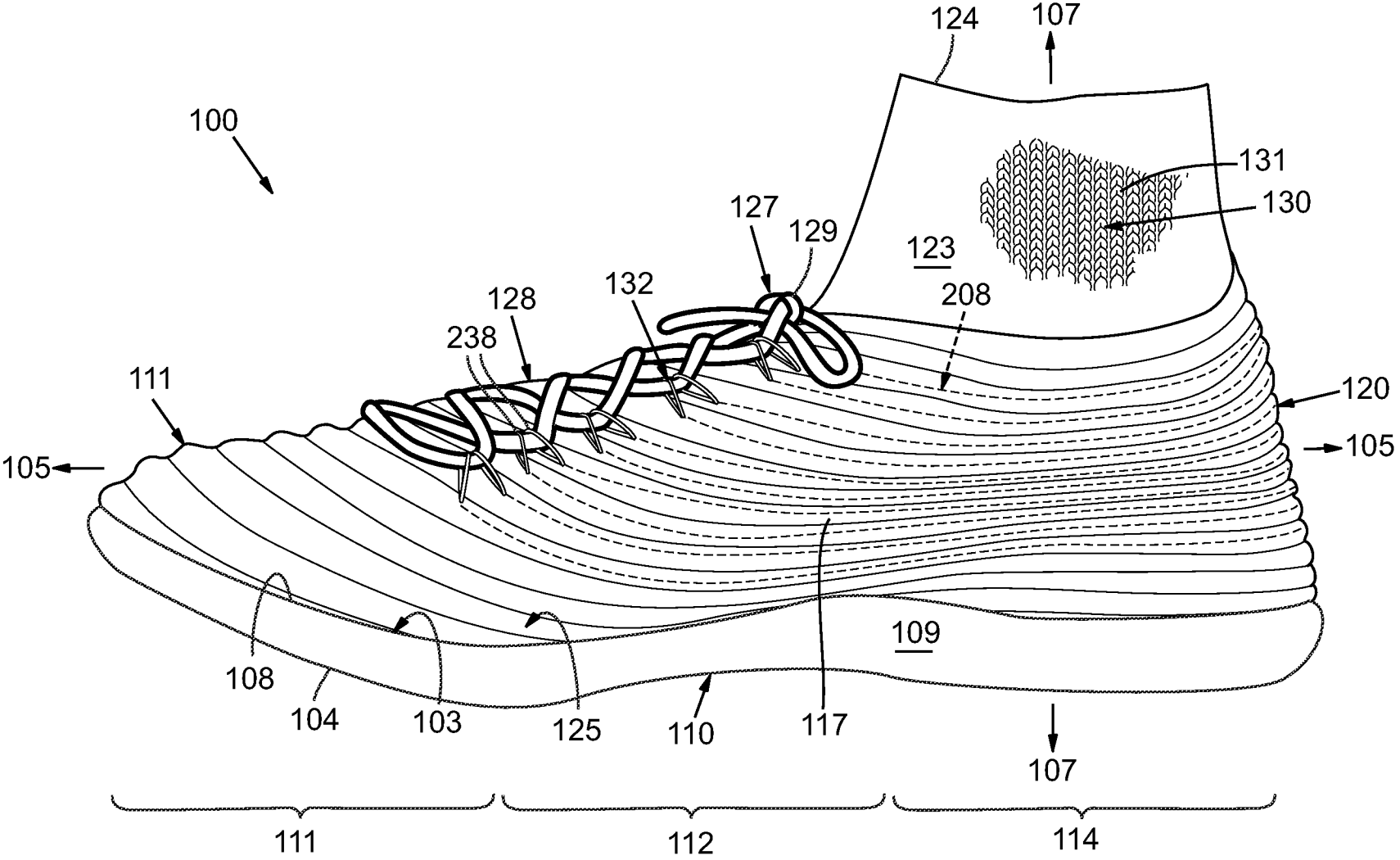
FIG. 4 is a medial side view of the article of footwear of FIG. 1.

Furthermore, as shown in FIGS. 2 and 4, when knitted component 130 is assembled to define upper, second tensile element 208 can include one or more segments that are disposed on medial side 117. Other segments of second tensile element 208 can extend continuously from medial side 117, across heel region 114, to lateral side 115. Specifically, second inner loop segments 238 can be disposed on medial side 117, proximate throat 128 to attach shoelace 192 to medial side 117. In contrast, second outer loop segments 240 (see FIGS. 2 and 4) can be disposed on lateral side 115, proximate sole structure 110 in midfoot region 112. Second intermediate sections 242 can extend continuously from inner loop segments 238 on medial side 117, across heel region 114, to outer loop segments 240 on lateral side 115. Stated differently, second tensile element 208 can extend back-and-forth continuously between throat 128 on medial side 117 and lower portion 125 on lateral side 115 as second tensile element 208 extends generally along the throat axis 101. As such, second tensile element 208 can be configured to transfer forces from throat 128 on medial side 117, across heel region 114, to lower portion 125 and sole structure 110 on lateral side 115. Thus, by tightening shoelace 129, tension of second tensile stand 208 can be increased, and medial side 117, heel region 114, and lateral side 115 can be pulled generally inward toward the wearer's foot. This can also cause upper 120 to generally compress the wearer's foot, especially in regions proximate heel region 114. Thus, upper 120 can conform and fit comfortably against the wearer's foot. Moreover, second tensile element 208 can resist deformation in these regions, for example, when the wearer's foot pushes against the medial side 117. As such, the second tensile element 208 can allow the wearer to move laterally (i.e. cut) in the transverse direction 106 more effectively.

Figure 17:
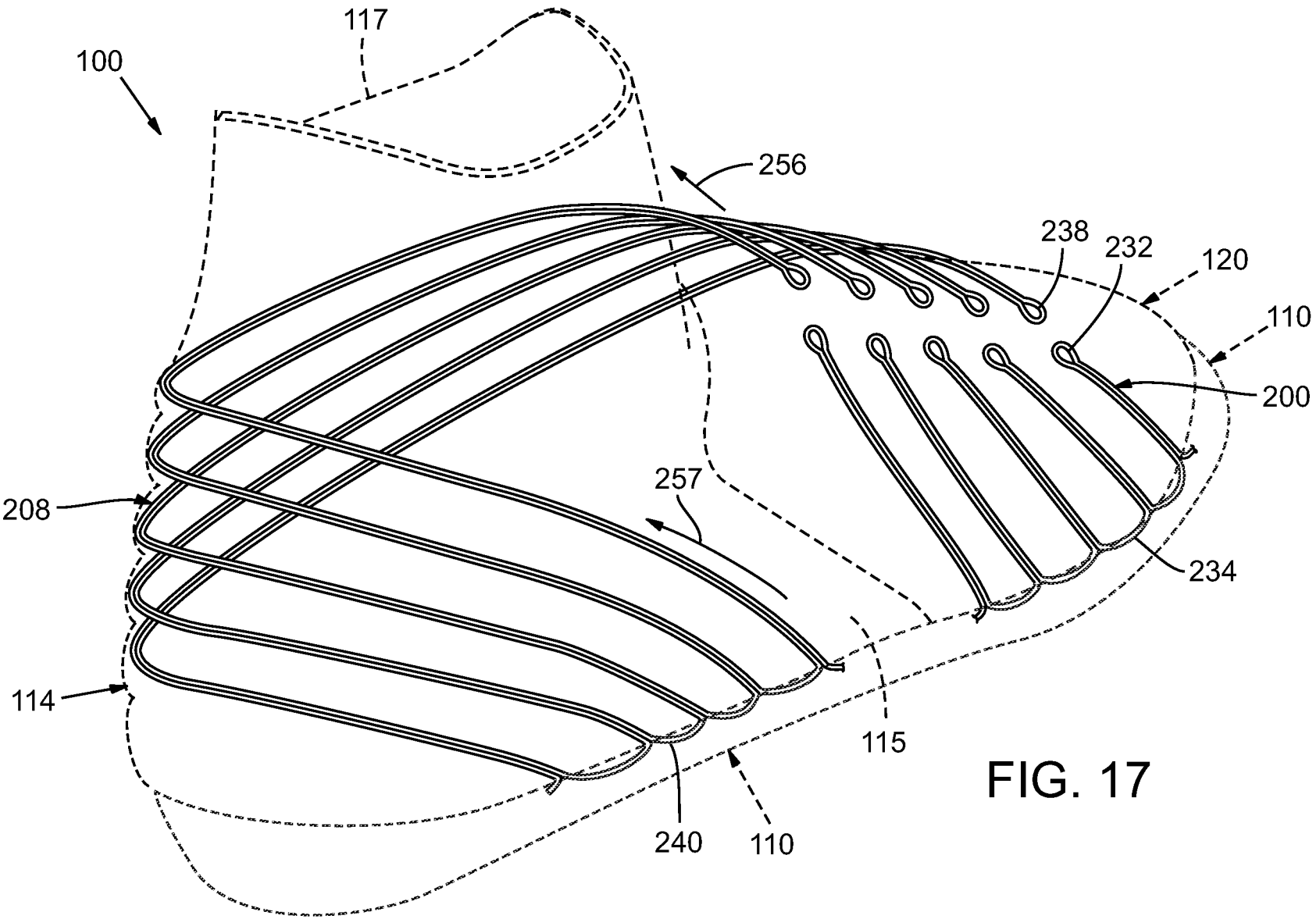
FIG. 17 is a perspective view of tensile elements of the article of footwear of FIG. 1, wherein other portions of the footwear are shown in phantom.

Moreover, as shown in FIG. 17, when the wearer's foot applies an input force (represented by arrow 256) to medial side 117, second tensile element 208 can transfer the force from medial side 117, across heel region 114, to lower portion 125 and sole structure 110 on lateral side 115 as represented by arrow 257. As a result, lower portion 125 and/or sole structure 110 on lateral side 115 can be pulled toward inward toward the wearer's foot. The direction of the force transfer can be reversed as well. For example, when an input force is applied proximate second outer loop segments 240, the force can be transferred across heel region 114, to second inner loop segments 238. Thus, footwear 100 can effectively support cutting and other movements of the wearer in the transverse direction 106.

Additionally, as shown in FIGS. 1, 5, and 6, first tensile element 200 and second tensile element 208 can cooperate to attach shoelace 129 to upper 120. Specifically, first row 244 of first inner loop segments 232 and second row 246 of second inner loop segments 238 can receive shoelace 129. In some embodiments, first row 244 can be offset from second row 246 along throat axis 101. Specifically, first row 244 can be disposed closer to forefoot region 111 than second row 246. Stated differently, first row 244 can extend partially in midfoot region 112 and forefoot region 111 whereas second row 246 can be disposed in midfoot region 112 only in some embodiments. As such, first and second tensile elements 200, 208 can be disposed in regions that are particularly prone to high loading.

Also, forces can be transferred from one tensile element to another via shoelace 129. For example, when an input force is applied to the lateral side 115, first tensile element 200 can transfer the force from lateral side 115 to shoelace 129. Shoelace 129 can, in turn, transfer this force to second tensile element 208. As a result, second tensile element 208 can transfer this force along medial side 117, across heel region 114, back to lateral side 115. Thus, the forces can be effectively distributed across a relatively large area of footwear 100. Also, tensile elements 200, 208 can constrict and/or compress knit element 131 toward the wearer's foot as a result of the force transfer. Accordingly, footwear 100 can provide a high degree of support, for example, when the wearer cuts, pushes off the ground, or otherwise moves the foot.

Additional Embodiments of Footwear

Figure 18:
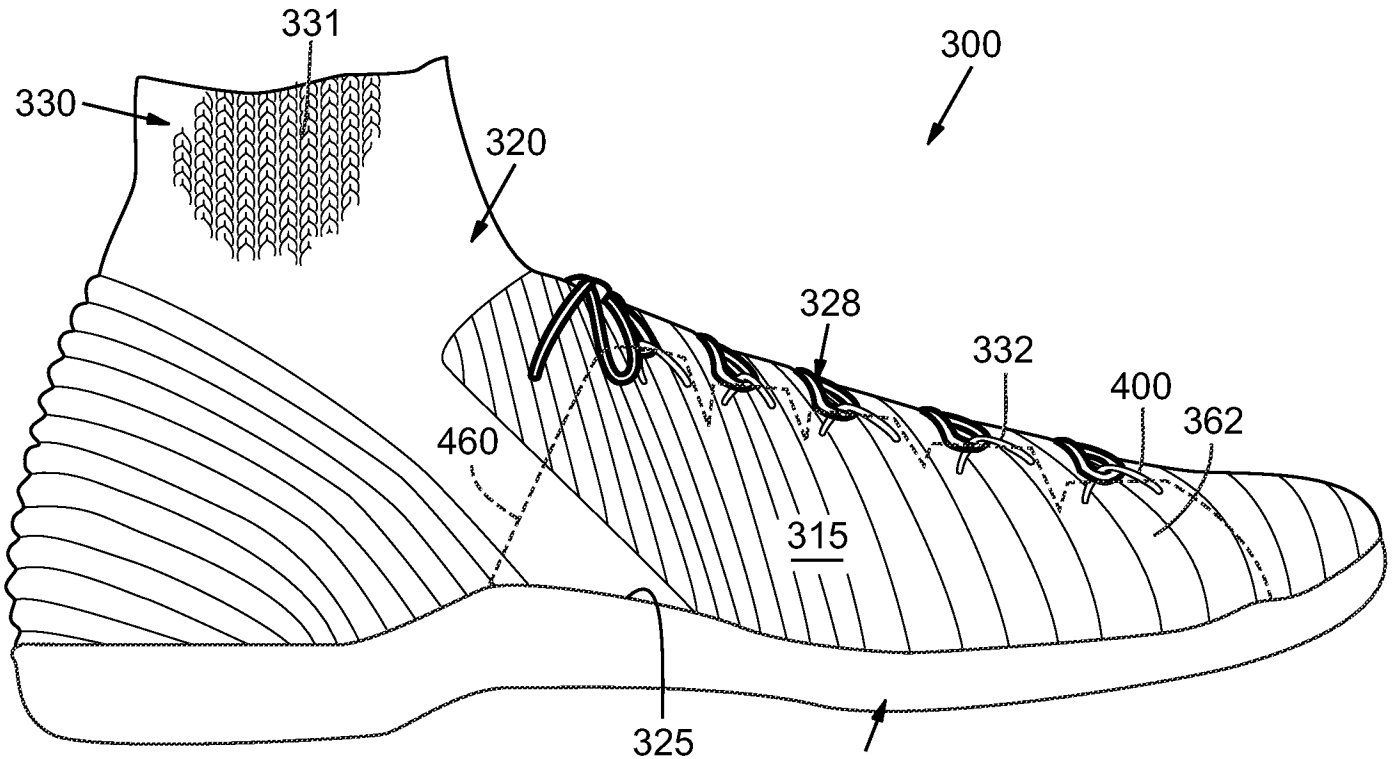
FIG. 18 is a lateral side view of an article of footwear according to additional exemplary embodiments of the present disclosure.
Figure 19:
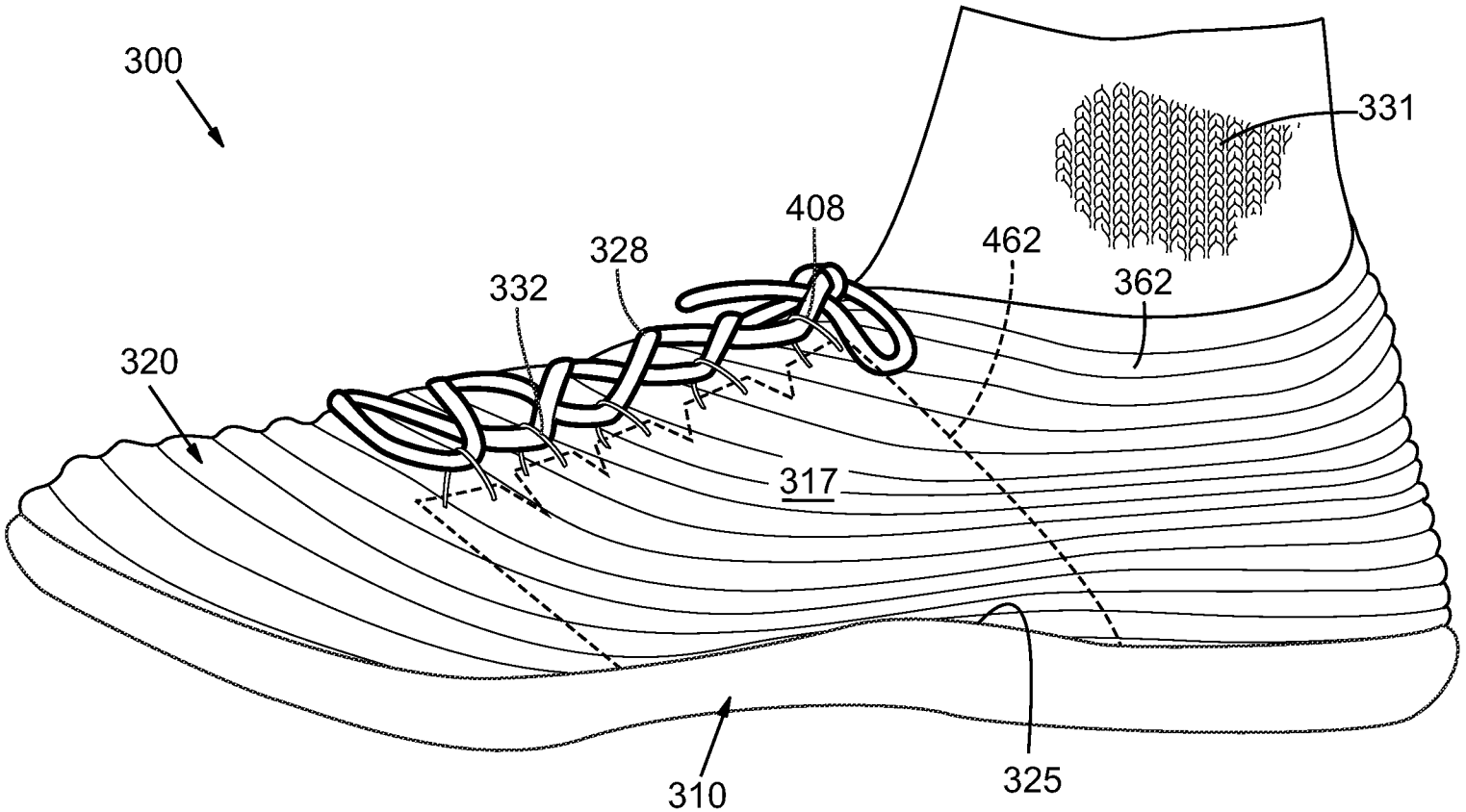
FIG. 19 is a medial side view of the article of footwear of FIG. 18.
Figure 20:
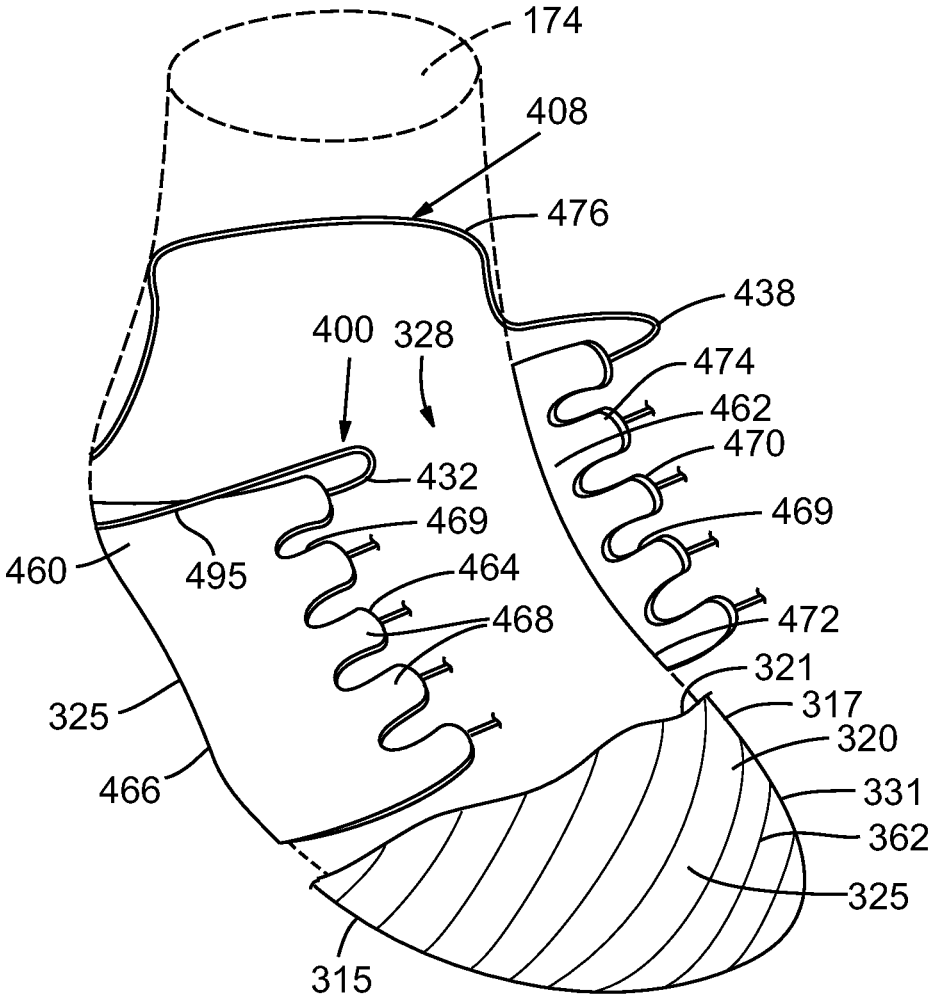
FIG. 20 is a detail perspective view of an upper of the article of footwear of FIG. 18, wherein portions of the upper have been hidden.

Referring now to FIGS. 18-20, additional embodiments of article of footwear 300 are illustrated according to the present disclosure. Footwear 300 can include several features corresponding to the embodiments of footwear 100 discussed above. Corresponding features will not be discussed in detail. Features that are different will be discussed in detail, however. Also, components of footwear 300 that correspond to footwear 100 will be identified with corresponding reference numbers increased by 200.

As shown, footwear 300 can generally include sole structure 310 and upper 320. Upper 320 can be defined at least partially by knitted component 330. Knitted component 330 can include a knit element 331 and one or more tensile elements 332.

In some embodiments represented in FIGS. 18, 19, and 20, footwear 300 can also include a first anchoring member 460 and a second anchoring member 462. Anchoring members 460, 462 can be flat, flexible sheets of material that are disposed within upper 320 in some embodiments.

As shown in FIG. 20, first anchoring member 460 can include a top end 464 and a bottom end 466. In some embodiments, top end 464 can include a plurality of projections 468 that are separated by respective openings 469. In some embodiments, openings 469 can be slits, cuts, or other openings that extend partially along first anchoring member 460 from top end 464. Also, in some embodiments, projections 468 can be rounded. Furthermore, bottom end 466 can be attached to lower portion 325 on lateral side 315.

Similarly, second anchoring member 462 can include a top end 470 and a bottom end 472. In some embodiments, top end 470 can include a plurality of projections 474 that are separated by respective openings 469. Furthermore, bottom end 472 can be attached to lower portion 325 on medial side 317.

In some embodiments, tensile elements 332 of knitted component 330 can include a first tensile element 400. First tensile element 400 can be disposed on footwear 100 generally similar to the embodiment of first tensile element 200 described above. However, first tensile element 400 can include a plurality of independent segments that are disposed generally on lateral side 315 and that extend generally between sole structure 310 and throat 328. Also, at least one or more of these segments of first tensile element 400 can extend through tubular rib structures 362.

Specifically, a representative segment 495 of first tensile element 400 is indicated in FIG. 20. As shown, segment 495 of first tensile element 400 can be fixed to lower portion 325 of upper 320 and/or sole structure 310 on lateral side 315. From there, segment 495 can extend through a respective tubular rib structure 416 on lateral side 317 toward throat 328. At throat 328, segment 495 can extend out of knit element 331 from exterior surface 323 and back toward knit element 331 to define first inner loop segment 432. Segment 495 can continue by extending into exterior surface 323, through knit element 331, and back out of knit element 331 via interior surface 321. Segment 495 can terminate inside upper 320 and can be attached to a projection 468 of first anchoring member 460. Thus, segment 495 can be attached to lower portion 325 and/or sole structure 310 on lateral side 315 via first anchoring member 460. Other segments of first tensile element 400 can be routed similar to segment 495, except that other segments can be attached to different projections 468. Thus, segments of first tensile element 400 can support lateral side 315 of footwear 300 as discussed above in detail with respect to first tensile element 200.

Additionally, tensile elements 332 of knitted component 330 can include a second tensile element 408. Second tensile element 408 can be disposed on footwear 100 generally similar to the embodiment of second tensile element 208 described above. However, second tensile element 408 can include a plurality of independent segments that extend generally from medial side 317, across heel region 314, to lateral side 415. Also, these segments of second tensile element 408 can extend from throat 328 on medial side 317, across heel region 314, to lower portion 325 and sole structure 310 on lateral side 315. Additionally, at least one or more of these segments of second tensile element 408 can extend through tubular rib structures 362.

Specifically, a representative segment 476 of second tensile element 408 is indicated in FIG. 20. As shown, segment 476 of first tensile element 400 can be fixed to lower portion 325 of upper 320 and/or sole structure 310 on lateral side 315. From there, segment 476 can extend through a respective tubular rib structure 416 on lateral side 417, across heel region 314, toward throat 328 on medial side 317. At throat 328, segment 476 can extend out of knit element 331 from exterior surface 323 and back toward knit element 331 to define second inner loop segment 438. Segment 476 can continue by extending into exterior surface 323, through knit element 331, and back out of knit element 331 via interior surface 321. Segment 476 can terminate inside upper 320 and can be attached to a projection 474 of second anchoring member 462. Thus, segment 476 can be attached to lower portion 325 and/or sole structure 310 on medial side 317 via second anchoring member 462. Other segments of second tensile element 408 can be routed similar to segment 476, except that other segments can be attached to different projections 474. Thus, segments of second tensile element 408 can support medial side 315 and heel region 314 of footwear 300 as discussed above in detail with respect to second tensile element 208. Also, segments of second tensile element 408 can transfer forces from throat 328 on medial side 317, across heel region 314, to lower portion 325 on lateral side 315, similar to the embodiments of second tensile element 208 discussed in detail above.

Figure 21:
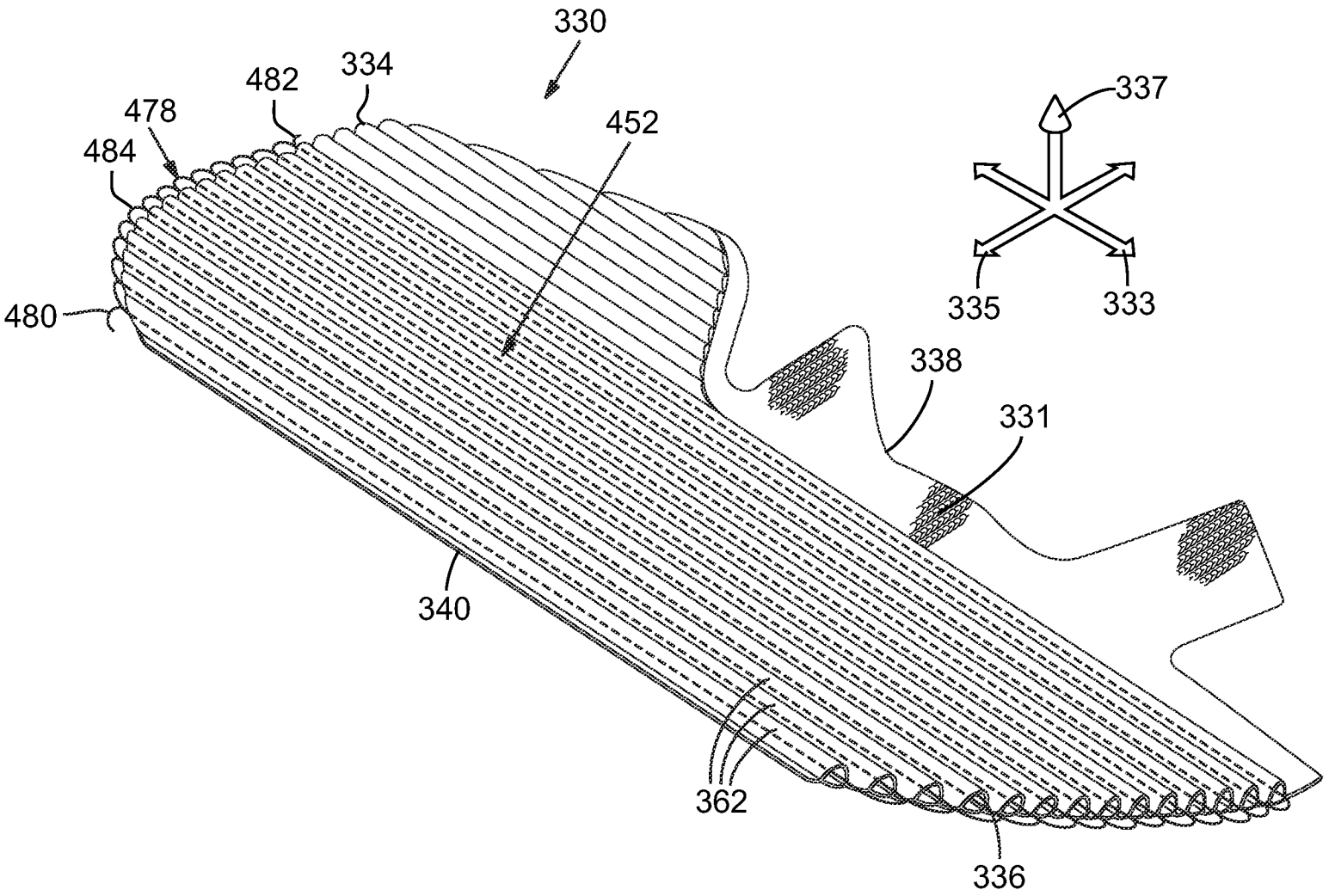
FIG. 21 is a perspective view of a knitted component of the article of footwear of FIG. 18.

FIGS. 21-25 illustrate the manufacture of knitted component 330 according to exemplary embodiments. As shown in FIG. 21, knit element 331 can be substantially similar to knit element 131 discussed above with respect to FIG. 7. Also, in some embodiments, knitted component 330 can be initially formed with a single, continuous tensile element 478 that extends through one or more tubular rib structures 362. In some embodiments, tensile element 478 can include a first end 480, a second end 482, and an intermediate section 484 that extends continuously between first and second ends 480, 482.

First end 480 and second end 482 can be exposed from first end 334 of knit element 431. Intermediate section 484 can extend through multiple tubular rib structures 362 as it extends back and forth between first end 334 and second end 336.

Figure 22:
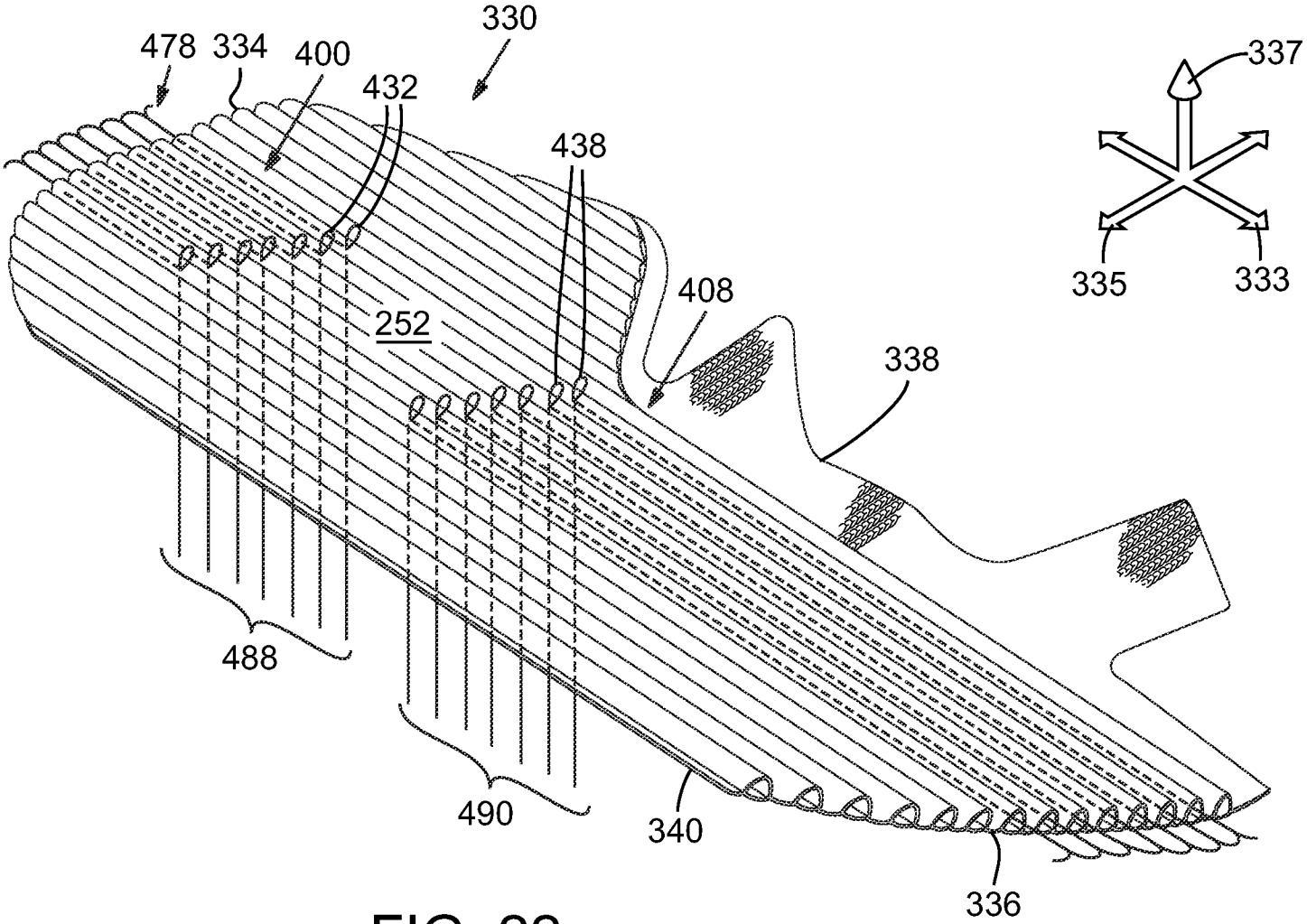
FIG. 22 is a perspective view of the knitted component of FIG. 21, wherein a tensile element of the knitted component has been adjusted relative to a knit element of the knitted component.

Once formed as shown in FIG. 21, tensile element 478 can be moved and adjusted relative to knit element 331 as shown in FIG. 22. For example, tensile element 478 can be pulled from and removed from predetermined tubular rib structures 416 in some embodiments. As shown in FIG. 22, for example, tensile element 478 can be removed from multiple tubular rib structures 416 that are proximate bottom edge 340, leaving tensile element 478 present in the tubular rib structures 416 disposed closer to top edge 338. Then, portions of tensile element 478 can be cut using a cutting tool, such as scissors. In some embodiments, tensile element 478 can be cut in areas proximate throat area 452. In some embodiments, tensile element 478 can be cut one time at each segment that traverses throat area 452 and pulled from throat area 452. It will be appreciated that, when cut, tensile element 478 can be divided generally to define first tensile element 400 and second tensile element 408. It will also be appreciated that this cutting can create a plurality of first free ends 488 of first tensile element 400 and a plurality of second free ends 490 of second tensile element 408.

Figure 23:
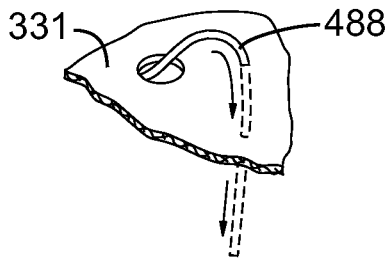
FIG. 23 is a detail view of an exemplary segment of the tensile element of FIG. 22 shown being adjusted relative to the knit element.
Figure 24:
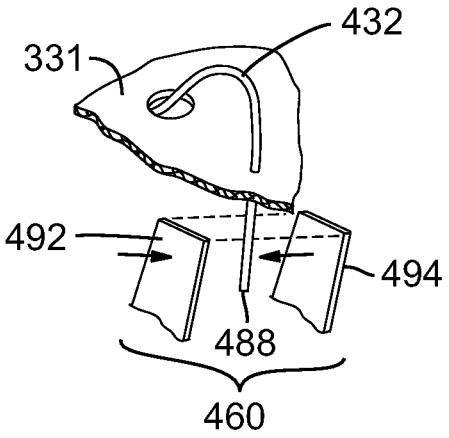
FIG. 24 is a detail view of the segment of the tensile element of FIG. 23 shown being attached to an anchoring member.

As shown in FIGS. 23 and 24, first free end 488 can be pulled out from knit element 331 and through the thickness of knit element 331 to define loop segment 432. Then, as shown in FIG. 24, first free end 488 can be attached to anchoring member 460. For example, in some embodiments, first free end 488 can be attached between a first layer 492 and a second layer 494 of anchoring member 460. In some embodiments, first layer 492, second layer 494, and first free end 488 can be attached via adhesives. However, it will be appreciated that these members can be attached via fasteners or other attachment devices in other embodiments. It will also be appreciated that second free ends 490 of second tensile element 408 can be adjusted relative to knit element 331 to define loop segments 438 and then pulled through knit element 331 and attached to second anchoring member 462 in a manner similar to the embodiments illustrated in FIGS. 22-24.

Accordingly, footwear 300 can achieve similar advantages to those discussed above with respect to footwear 100. In addition, first and second anchoring members 460, 462 can provide additional support for lateral side 315 and medial side 317. Anchoring members 460, 462 can further provide a secure and convenient means for attaching tensile elements 332 to lower portion 325 and/or sole structure 310.

While various embodiments of the present disclosure have been described, the description is intended to be exemplary, rather than limiting, and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An upper, comprising:

a knitted component, comprising:

a knit element; and a plurality of tensile segments extending through the knit element, the plurality of tensile segments comprising a first tensile segment and a second tensile segment that each extend from a throat area to a perimeter edge extending around a toe area, wherein a spacing between the first tensile segment and the second tensile segment increases towards the toe area.

2. The upper of claim 1, wherein the plurality of tensile segments extend to a plurality of locations about an outer edge of the toe area.

3. The upper of claim 1, wherein at least a portion of the plurality of tensile segments extend on a medial side of the upper.

4. The upper of claim 1, wherein at least a portion of the plurality of tensile segments extend on a lateral side of the upper.

5. The upper of claim 1, wherein at least a portion of the plurality of tensile segments form exposed loops on the upper.

6. The upper of claim 1, wherein each of the plurality of tensile segments extends through a corresponding tunnel in the knit element.

7. The upper of claim 1, wherein each of the plurality of tensile segments comprises a yarn.

8. The upper of claim 1, wherein each of the plurality of tensile segments comprises a strand.

9. The upper of claim 1, wherein each of the plurality of tensile segments comprises a cable.

10. The upper of claim 1, wherein each of the plurality of tensile segments comprises a filament.

11. The upper of claim 10, wherein the filament comprises a monofilament.

12. The upper of claim 1, wherein a thickness of each of the plurality of tensile segments is greater than a thickness of one or more yarns forming the knit element.

13. The upper of claim 1, wherein a stretch-resistance of each of the plurality of tensile segments is greater than a stretch-resistance of one or more yarns forming the knit element.

14. The upper of claim 1, wherein each of the plurality of tensile segments comprises:

glass;

aramid;

polyethylene; or liquid crystal polymer.

15. The upper of claim 1, wherein the upper comprises part of an article of footwear.

16. An article of footwear, comprising:

an upper, comprising:

a knitted component, comprising:

a knit element, and a plurality of tensile segments extending through the knit element, the plurality of tensile segments comprising a first tensile segment and a second tensile segment that each extend from a throat area to a perimeter edge extending around a toe area, wherein a spacing between the first tensile segment and the second tensile segment increases towards the toe area.

17. The article of footwear of claim 16, wherein each of the plurality of tensile segments extends through a corresponding tunnel in the knit element.

18. The article of footwear of claim 16, wherein each of the plurality of tensile segments comprises a yarn, a cable, a cord, or a filament of a higher stretch-resistance than one or more yarns forming the knit element.

19. The article of footwear of claim 16, wherein a stretch-resistance of each of the plurality of tensile segments is greater than a stretch-resistance of one or more yarns forming the knit element.

20. A method of manufacturing an article of footwear, the method comprising:

forming an upper such that it comprises:

a knit element, and a plurality of tensile segments extending from a throat area to a perimeter edge extending around a toe area, wherein the plurality of tensile segments comprises a first tensile segment and a second tensile segment that each extend from the throat area towards the toe area, wherein a spacing between the first tensile segment and the second tensile segment increases as the first tensile segment and the second tensile segment transition towards the toe area; and attaching the upper to a sole structure.

* * * * *